US006817699B2

(12) United States Patent
Hirashima et al.

(10) Patent No.: US 6,817,699 B2
(45) Date of Patent: Nov. 16, 2004

(54) PRINTER

(75) Inventors: Shigeyoshi Hirashima, Kangawa (JP); Akihito Miyazaki, Kanagawa (JP); Toshiki Kagami, Kanagawa (JP); Hiromitsu Takeda, Tokyo (JP); Hiroshi Tokunaga, Tokyo (JP); Kazuyasu Takenaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/466,904

(22) PCT Filed: Jan. 18, 2002

(86) PCT No.: PCT/JP02/00340

§ 371 (c)(1),
(2), (4) Date: Dec. 15, 2003

(87) PCT Pub. No.: WO02/058936

PCT Pub. Date: Aug. 1, 2002

(65) Prior Publication Data

US 2004/0085398 A1 May 6, 2004

(30) Foreign Application Priority Data

Jan. 23, 2001 (JP) ..... 2001-014181
Feb. 15, 2001 (JP) ..... 2001-038134

(51) Int. Cl.[7] ..... B41J 2/14; B41J 2/16
(52) U.S. Cl. ..... 347/49
(58) Field of Search ..... 347/86, 49, 108, 347/109, 50

(56) References Cited

U.S. PATENT DOCUMENTS 5,138,344 A * 8/1992 Ujita ..... 347/86
6,357,854 B1 * 3/2002 Igval et al. ..... 347/36

FOREIGN PATENT DOCUMENTS

| | | |
|---|---|---|
| JP | 02-88248 | 3/1990 |
| JP | 05-221066 | 8/1993 |
| JP | 05-221105 | 8/1993 |
| JP | 09-292815 | 11/1997 |

* cited by examiner

*Primary Examiner*—Thinh Nguyen
(74) *Attorney, Agent, or Firm*—Sonnenschein, Nath & Rosenthal LLP

(57) ABSTRACT

Disclosed herein is a printer having a printer body and a consumable related to printing means, such as an ink cartridge and an ink ribbon, wherein the consumable can be very easily replaced and the electrical connection between the consumable and the printer body can be easily effected. In a printer (1) having a printer body (6) and an ink cartridge (consumable related to printing means) (19) replaceably mounted in the printer body, an ink cartridge tray (consumable tray) (8) for detachably storing the ink cartridge is movably provided in the printer body. A connector (37) provided on the ink cartridge is connected to a connector (38) provided in the printer body when the ink cartridge tray is inserted into the printer body.

10 Claims, 32 Drawing Sheets

PRINTER

TECHNICAL FIELD

The present invention relates to a printer for printing an image (inclusive of characters) on a sheet of paper, such as a copying machine, a facsimile, and a printer as computer peripheral equipment, and more particularly to a technique for greatly facilitating the replacement of a consumable related to printing means, such as an ink cartridge and an ink ribbon and also facilitating the electrical connection between the consumable and a printer body.

BACKGROUND ART

With the recent widespread use of a computer, a printer as computer peripheral equipment has also become widespread. Such a printer employs various types of printing means for effecting print on a sheet of paper, such as an ink jet type and an ink ribbon type.

In such an ink jet type or an ink ribbon type, the ink is a consumable and it is therefore necessary to replace an ink cartridge or an ink ribbon.

In such a conventional printer, however, the ink cartridge or ink ribbon is replaced by first removing a cover, upper lid, or side lid from a printer body to expose the ink cartridge or ink ribbon and next removing the ink cartridge or ink ribbon from the printer body. Thus, the replacement of the ink cartridge or ink ribbon is troublesome or there is a case that the ink cartridge or ink ribbon cannot be replaced by any persons other than a skilled person knowing the know-how and points to check in the replacement work (first problem).

Further, in the case that electrical connection must be made between the printer body and a component attached to the ink cartridge or ink ribbon, it is necessary to connect the ink cartridge or ink ribbon through a cable or connector to the printer body independently of mounting of the ink cartridge or ink ribbon into the printer body. Thus, this connection work is troublesome to result in low workability (second problem).

It is accordingly an object of the present invention to provide a printer which can greatly facilitate the replacement of a consumable related to printing means, such as an ink cartridge and an ink ribbon and can also facilitate the electrical connection between the consumable and the printer body.

DISCLOSURE OF INVENTION

According to an aspect of the present invention for solving the first problem mentioned above, there is provided a printer having a printer body and a consumable related to printing means, the consumable being replaceably mounted in the printer body, the printer including a consumable tray movably provided in the printer body for detachably storing the consumable.

With this configuration, the replacement of the consumable can be very easily performed by simply ejecting the consumable tray from the printer body. Thus, it is possible to provide a printer improved in usability.

According to another aspect of the present invention for solving the second problem mentioned above, there is provided a printer having a printer body and a consumable related to printing means, the consumable being replaceably mounted in the printer body, the printer including a consumable tray movably provided in the printer body for detachably storing the consumable; a first connector provided on the consumable or the consumable tray; and a second connector provided in the printer body; the first connector being connected to the second connector when the consumable tray is inserted into the printer body.

With this configuration, the replacement of the consumable can be very easily performed by simply ejecting the consumable tray from the printer body. Moreover, the electrical connection between the consumable and the printer body can be effected by simply inserting/ejecting the consumable tray into the printer body. Thus, it is possible to provide a printer improved in usability.

BEST MODE FOR CARRYING OUT THE INVENTION

Figure 1:
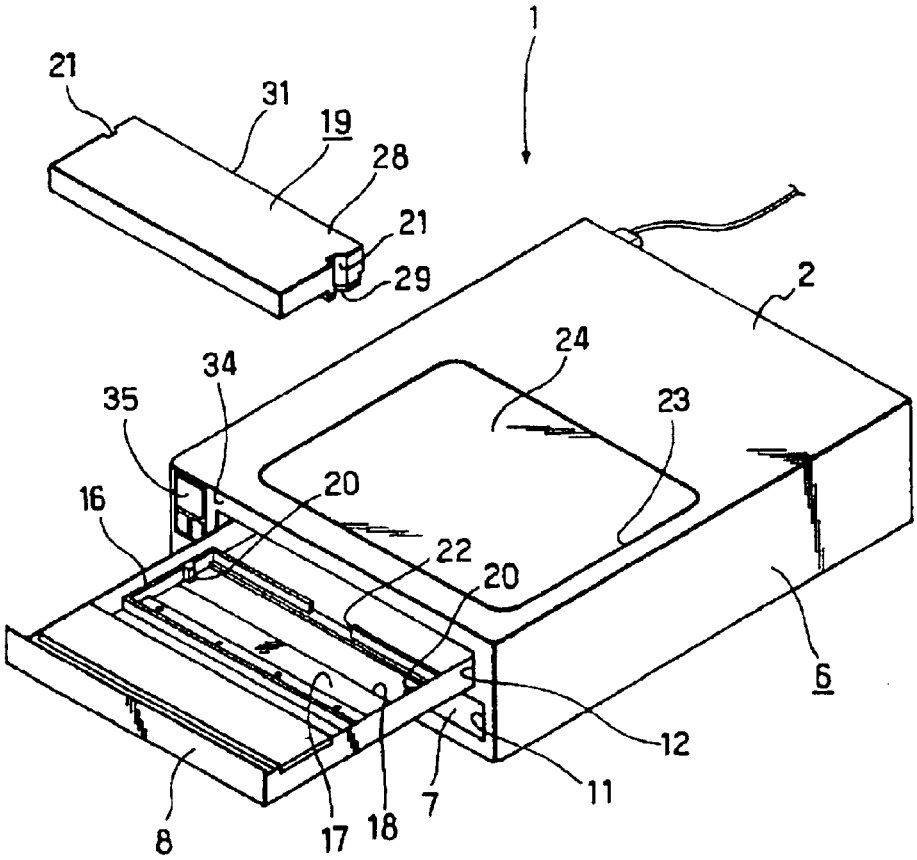
FIG. 1 is a perspective view showing a first preferred embodiment of the printer according to the present invention in the condition where an ink cartridge tray is ejected from a housing and an ink cartridge is removed from the ink cartridge tray.

Some preferred embodiments of the printer according to the present invention will now be described with reference to the attached drawings.

A first preferred embodiment of the printer according to the present invention is shown in FIGS. 1 to 23.

The first preferred embodiment is intended to solve the first problem mentioned above.

The first preferred embodiment shown is an application of the present invention to a so-called line head type ink jet printer.

Reference numeral 1 generally denotes such a printer, which has a boxlike housing 2 substantially flattened in its vertical direction. A mechanical section 5 including a paper feed system 4 for feeding a sheet of paper 3 is accommodated in the housing 2 to configure a printer body 6 (see FIG. 2).

Most of the printer body 6 except the mechanical section 5 is defined as accommodation spaces 9 and 10 for respectively accommodating a paper tray 7 and an ink cartridge tray 8 each to be hereinafter described. The front surface of the housing 2 is formed with two openings 11 and 12 for respectively allowing insertion/ejection of the paper tray 7 and the ink cartridge tray 8, so that the openings 11 and 12 communicate with the accommodation spaces 9 and 10, respectively (see FIG. 1).

The paper tray 7 is removably mounted in the lower space 9 so as to be slidable by a slide mechanism (not shown). In the condition where the paper tray 7 has been removed from the housing 2, a plurality of sheets of paper 3 are supplied to the paper tray 7.

A push plate 13 for pushing up the sheets of paper 3 is provided on the lower inner surface of the paper tray 7 at a front end portion thereof. The sheets of paper 3 stored in the paper tray 7 are slightly pushed up at their rear end portions by the push plate 13, and the uppermost sheet of paper 3 is pressed on a pickup roller 14 to be hereinafter described (see FIG. 2).

Figure 2:
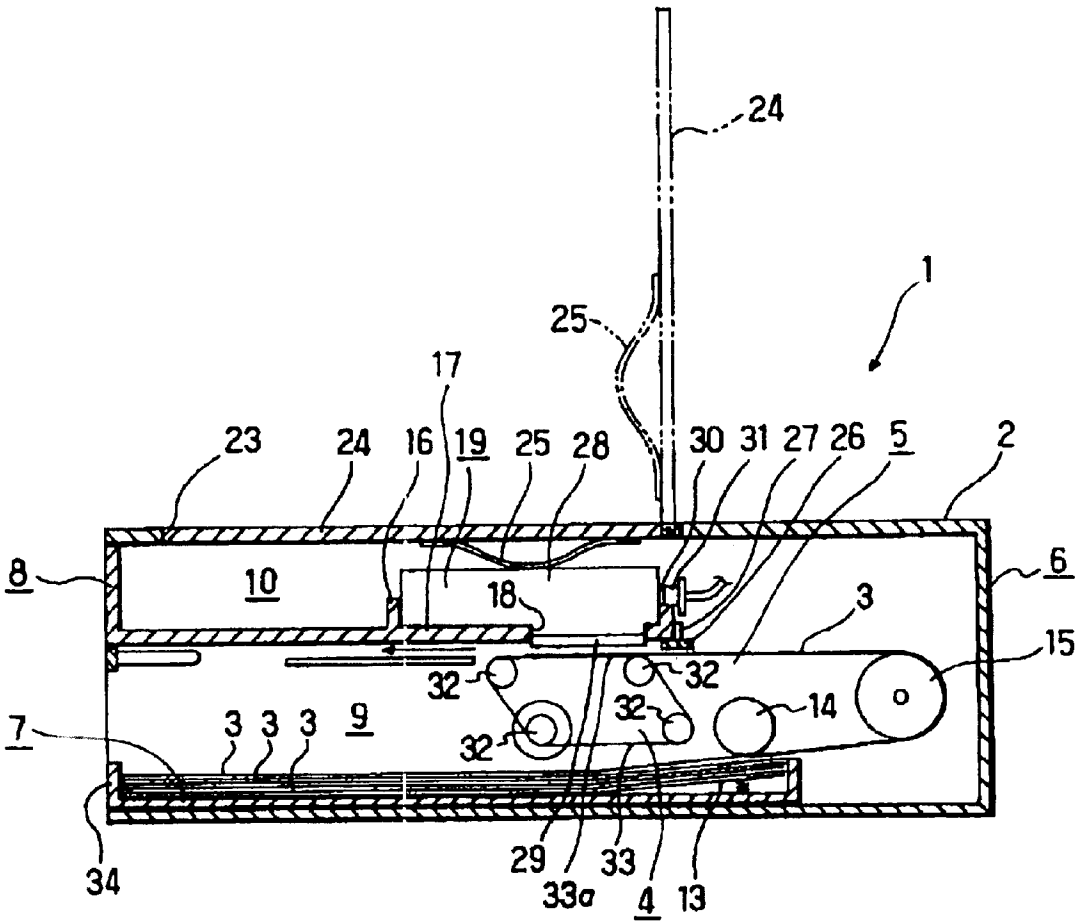
FIG. 2 is a plan view of the printer with its internal structure partially shown in the condition where the ink cartridge tray is ejected from the housing.

The uppermost sheet of paper 3 picked up by the pickup roller 14 is once fed toward a rear end portion of the housing 2 and next fed back toward a front end portion of the housing 2 by a reversing roller 15 for reversing the direction of running of the sheet of paper 3 being fed (see FIG. 2).

The ink cartridge tray 8 is also removably mounted in the upper space 10 so as to be slidable by a slide mechanism (not shown). The rear half of the ink cartridge tray 8 is formed with a storage space 17 surrounded by a frame 16. The lower surface of the storage space 17 is formed with a relatively large lower opening 18 (see FIG. 2).

Figure 3:
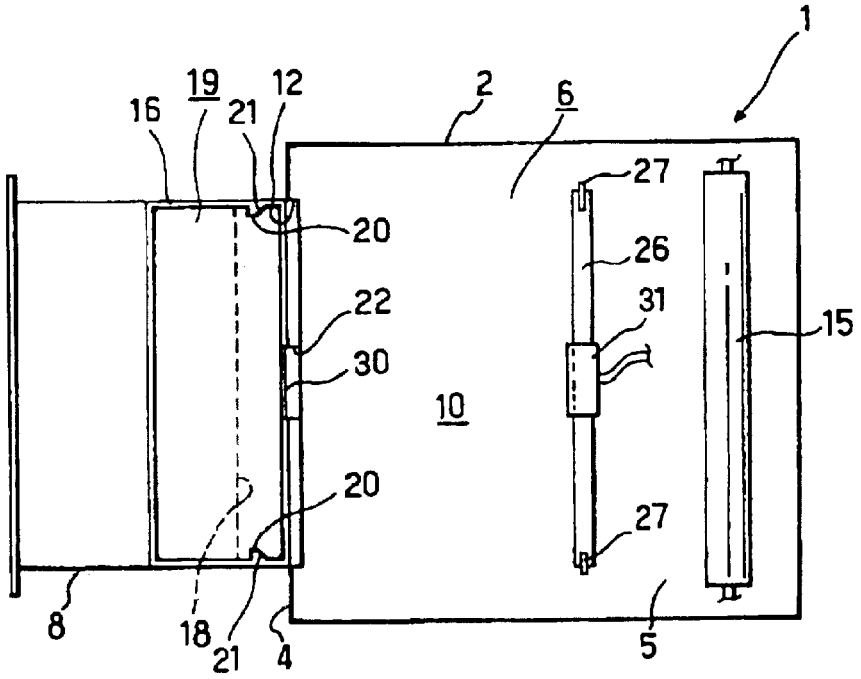
FIG. 3 is a plan view similar to FIG. 2, showing a condition where the ink cartridge tray is fully inserted in the housing.
Figure 4:
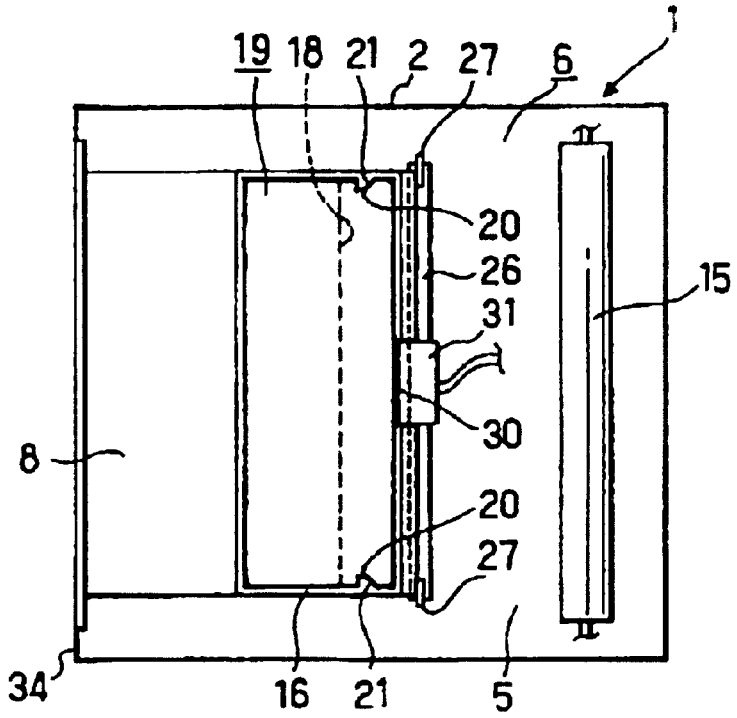
FIG. 4 is a longitudinal sectional view showing an essential part of the printer in the condition where the ink cartridge tray is fully inserted in the housing.
Figure 5:
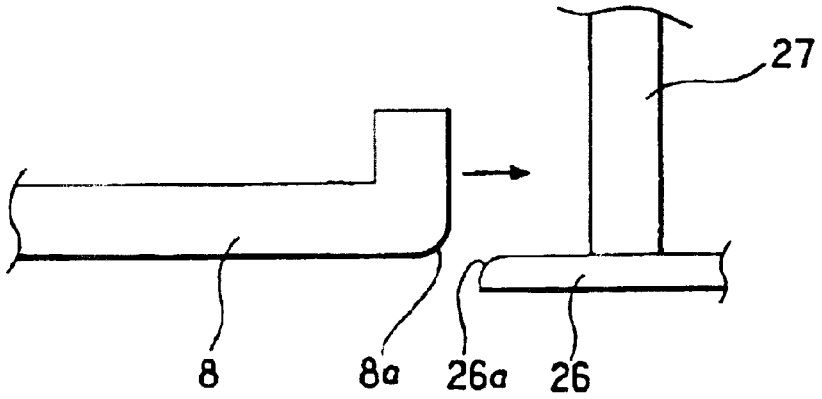
FIG. 5 is an enlarged sectional view of an essential part of the printer, showing a condition just before positioning the ink cartridge tray in the housing.
Figure 6:
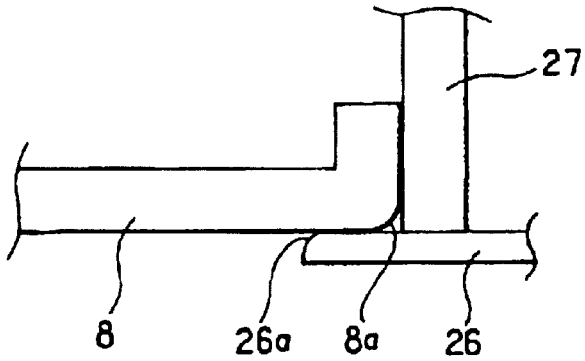
FIG. 6 is a view similar to FIG. 5, showing a condition where the ink cartridge tray is positioned in the housing.
Figure 7:
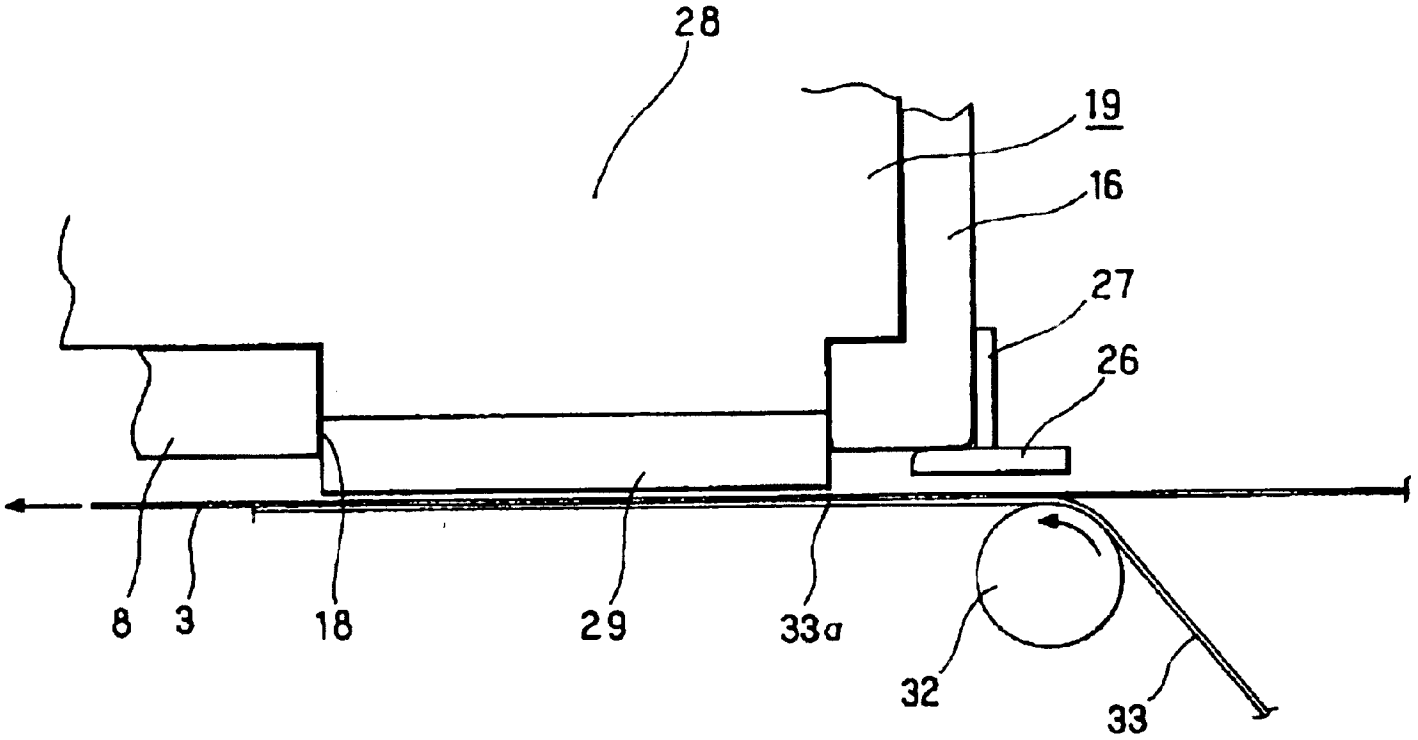
FIG. 7 is an enlarged sectional view showing a positional relation between a printer head and a sheet of paper.

A vertically flattened, rectangular ink cartridge 19 having a size substantially equal to or slightly smaller than that of the storage space 17 of the ink cartridge tray 8 is closely fitted with the storage space 17 (see FIGS. 3 and 4).

The right and left side walls of the frame 16 are formed with a pair of projections 20 for prevention of improper mounting of the ink cartridge 19, and the right and left side surfaces of the ink cartridge 19 are formed with a pair of notches 21 adapted to engage with the projections 20 of the frame 16 (see FIGS. 1, 3, and 4).

The rear wall of the frame 16 is formed at its transversely central portion with a cutout 22 for allowing the electrical connection between the ink cartridge 19 and the printer body 6 (see FIGS. 3 and 4).

The upper surface of the housing 2 is formed with an upper opening 23 at a position corresponding to the ink cartridge tray 8 in which the ink cartridge 19 is mounted, and the upper opening 23 is normally closed by an upper cover 24 pivotably supported to the housing 2 (see FIGS. 1 and 2).

The inner surface of the upper cover 24 is provided with depression means 25 at a position corresponding to the ink cartridge 19. The depression means 25 functions so that when the ink cartridge tray 8 containing the ink cartridge 19 is inserted into the printer body 6 in the closed condition of the upper cover 24, the ink cartridge 19 is depressed down by the depression means 25.

Accordingly, the ink cartridge 19 and the ink cartridge tray 8 are depressed down to be vertically positioned as will be hereinafter described, thereby defining the positional relation between the ink cartridge 19 and the sheet of paper 3 passing thereunder (see FIG. 2). While the depression means 25 is provided on the upper cover 24 in this preferred embodiment, it may be provided in the printer body 6 or the housing 2. More generally, the depression means 25 may be provided at any position where the ink cartridge tray 8 or the ink cartridge 19 mounted therein is depressed down by the depression means 25 when the ink cartridge tray 8 is inserted into the printer body 6.

The printer body 6 is provided with a transversely extending receiving plate 26 at the rear end of the upper space 10 in the housing 2 for accommodating the ink cartridge tray 8. The receiving plate 26 functions to receive the lower surface of the rear end portion of the ink cartridge tray 8 inserted into the upper space 10. Thus, the lower surface of the rear end portion of the ink cartridge tray 8 is placed on the receiving plate 26 to thereby effect vertical positioning of the ink cartridge tray 8. Further, since the ink cartridge tray 8 and the ink cartridge 19 are depressed down by the depression means 25 as mentioned above, the ink cartridge tray 8 and the ink cartridge 19 are accurately positioned inside the printer body 6 (see FIGS. 3 and 4).

The ink cartridge 19 includes an ink tank 28 and a printer head 29 integrated with each other (see FIG. 2). The printer head 29 is a so-called line head having many ink discharge holes (not shown) arranged transversely in a line per color. For example, four line heads for four colors are arranged longitudinally (in a paper feed direction) at given intervals. Accordingly, when the sheet of paper 3 is passed under the printer head 29, a line image is printed by each line head and subsequent line images are sequentially printed in accordance with the feed of the sheet of paper 3, thereby effecting printing of desired characters or images.

When the ink cartridge 19 is mounted into the storage space 17 of the ink cartridge tray 8, the printer head 29 of the ink cartridge 19 is fitted with the lower opening 18 and slightly projects from the lower outer surface of the ink cartridge tray 8 (see FIG. 2).

The front end of the receiving plate 26 is formed with a rounded surface 26*a*, and the rear end of the ink cartridge tray 8 at its lower end is also formed with a rounded surface 8*a*. Accordingly, even when the ink cartridge tray 8 is inserted in its slightly vertically shifted condition, the rounded surface 8*a* of the ink cartridge tray 8 comes into contact with the rounded surface 26*a* of the receiving plate 26 to allow smooth placement of the ink cartridge tray 8 on the receiving plate 26, thereby effecting vertical positioning of the ink cartridge tray 8 (see FIGS. 5 and 6).

The printer body 6 is further provided with a pair of positioning plates 27 at its transversely opposite ends so that the rear end of the ink cartridge tray 8 comes into abutment against the positioning plates 27. Accordingly, when the ink cartridge tray 8 is inserted into the printer body 6 until abutting against the positioning plates 27, the ink cartridge tray 8 is positioned longitudinally of the printer body 6 (in the direction of insertion) (see FIGS. 5 and 6).

Consequently, when the ink cartridge tray 8 is inserted into the upper space 10 of the printer body 6, the ink cartridge tray 8 is positioned both longitudinally and vertically with respect to the printer body 6, thereby defining the positional relation between the ink cartridge 19 mounted in the ink cartridge tray 8 and the printer body 6, that is, the sheet of paper 3. If the printer head 29 mounted in the ink cartridge tray 8 is inclined an angle θ with respect to the feed direction of the sheet of paper 3 in the horizontal plane, there occurs so-called color shift in printing. According to this preferred embodiment, however, the rear end of the ink cartridge tray 8 inserted in the printer body 6 abuts at its transversely opposite ends against the two positioning plates 27, thereby preventing the occurrence of the inclination angle θ.

Although the ink cartridge tray 8 is not positioned in the transverse direction, there is no problem in printing because the printer 1 is a line printer and the transverse direction of the printer head 29 is perpendicular to the feed direction of the sheet of paper 3.

A connector terminal 30 is formed on the rear surface of the ink cartridge 19. The connector terminal 30 is adapted to be electrically connected to a connector 31 provided in the printer body 6, thereby allowing supply of power to the printer head 29 to drive the printer head 29.

When the ink cartridge 19 is mounted into the storage space 17 of the ink cartridge tray 8, the connector terminal 30 is positioned to the cutout 22 of the frame 16. Further, when the ink cartridge tray 8 is inserted into the printer body 6, the connector 31 is relatively inserted into the cutout 22 and then connected to the connector terminal 30.

The paper feed system 4 is located substantially below the ink cartridge 19 mounted in the ink cartridge tray 8 inserted in the printer body 6, and the sheet of paper 3 reversed in its feed direction by the reversing roller 15 is passed under the printer head 29 (see FIG. 2).

The paper feed system 4 includes four feed rollers 32 and a feed belt 33 wrapped around the four feed rollers 32 in such a manner that the feed belt 33 forms a parallelogram as viewed in side elevation. An upper portion (paper feeding portion) 33*a* of the feed belt 33 is located in proximity to the printer head 29. Although not shown, the paper feeding portion 33*a* of the feed belt 33 is provided with a guide roller for pinching the sheet of paper 3 in cooperation with the feed belt 33.

The sheets of paper 3 individually picked up by the pickup roller 14 are first fed toward the reversing roller 15 located behind the paper tray 7, and the feed direction of each sheet of paper 3 is then reversed to the frontward direction by the reversing roller 15. Each sheet of paper 3 is next fed to the paper feed system 4.

The sheet of paper 3 fed to the paper feed system 4 is pinched by the guide roller (not shown) and the paper feeding portion 33*a* of the feed belt 33 and is passed under the printer head 29 in proximity thereto. At this time, printing on the sheet of paper 3 is effected by the printer head 29.

Although not described in detail, the ink cartridge tray 8 is inserted/ejected into/from the housing 2 by a driving portion provided in the slide mechanism (not shown). This driving portion is operated by operating a switch 35 provided on a front panel 34 of the printer body 6. Complete insertion of the ink cartridge tray 8 into the printer body 6 is detected by a sensor (not shown), and the operation of the driving portion is stopped at this time to effect positioning of the ink cartridge tray 8 with respect to the printer body 6.

In the case that the ink contained in the ink cartridge 19 has run out and the ink cartridge 19 is therefore required to be replaced by another new one, the switch 35 on the front panel 34 is manually operated to thereby eject the ink cartridge tray 8 out of the printer body 6 through the slide mechanism. In this condition, the ink cartridge 19 is exposed to the outside of the printer body 6, so that it can be removed from the ink cartridge tray 8. Thereafter, a new ink cartridge 19 is mounted into the storage space 17 of the ink cartridge tray 8. Thus, the replacement of the ink cartridge 19 can be easily performed (see FIG. 1).

In the printer 1 according to this preferred embodiment, the insert and eject operations of the ink cartridge tray 8 are performed by the slide mechanism. Accordingly, a known slide mechanism for a tape cassette or a disc cartridge, for example, may be used also for the slide mechanism for the ink cartridge tray 8, so that this slide mechanism can be realized with a relatively simple structure.

In the printer 1 according to this preferred embodiment, the ink cartridge 19 includes the ink tank 28 and the printer head 29 integrated with each other, so that an ink passage between the ink tank 28 and the printer head 29 can be formed as a closed space (because the ink passage is entirely formed in the ink cartridge 19). Accordingly, as compared with a case where the ink tank 28 and the printer head 29 are separated from each other, a problem of ink leakage or the like can be suppressed. The printer of the present invention is applicable also to a separate type such that a printer head is provided in an ink cartridge tray and an ink tank is replaceably mounted to the printer head. In this case, the above-mentioned connectors for electrically connecting the printer head and the printer body are not required.

Figure 8:
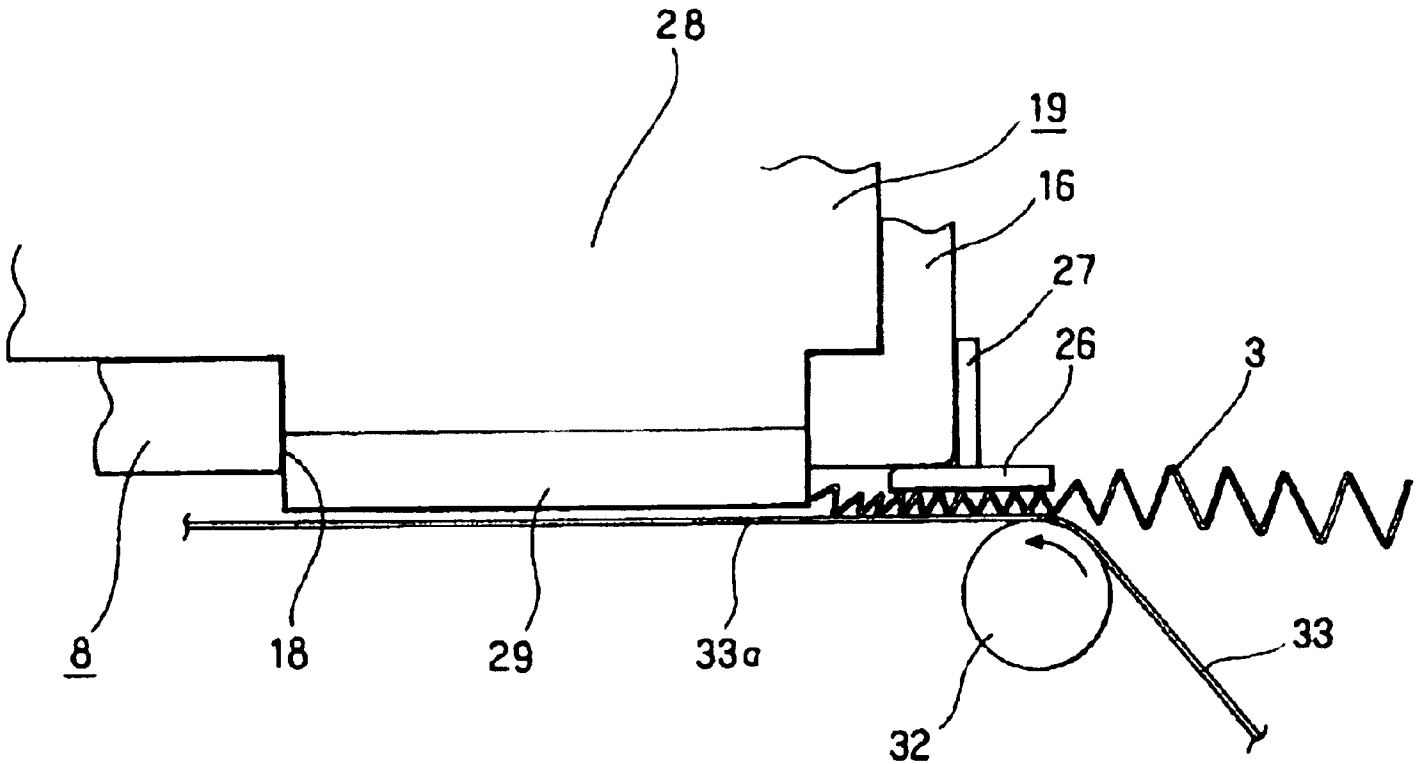
FIG. 8 is an enlarged sectional view showing a condition where the sheet of paper is caught by the printer head to incur jamming.
Figure 9:
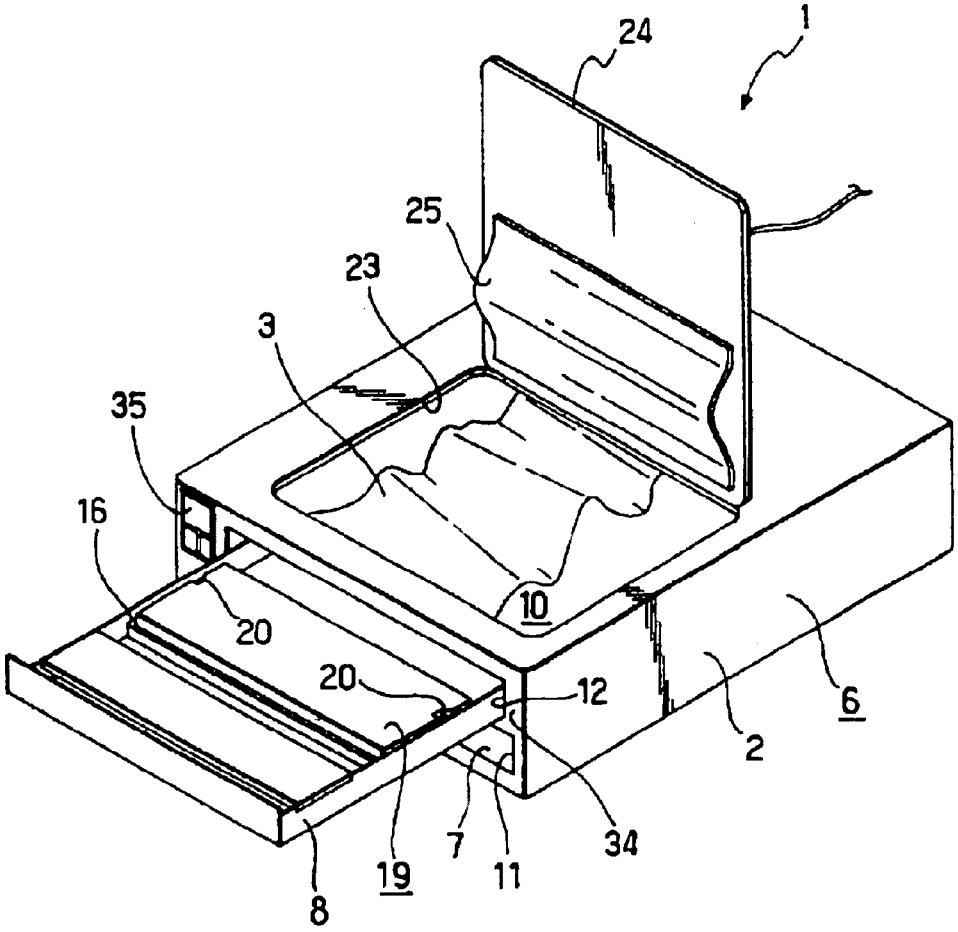
FIG. 9 is a perspective view showing a condition where an upper cover is opened to remove the jammed sheet of paper.

As mentioned above, the printer head 29 projects downwardly from the lower outer surface of the ink cartridge tray 8, so that there is a possibility that the sheet of paper 3 passing under the printer head 29 may be caught by the printer head 29 to cause so-called jamming (see FIG. 8).

In such a case, the jammed sheet of paper 3 can be easily removed by first ejecting the ink cartridge tray 8 from the printer body 6 and next opening the upper cover 24.

More specifically, the jammed sheet of paper 3 is caught by a projecting portion of the printer head 29 projecting downwardly. Accordingly, by ejecting the ink cartridge tray 8 mounting the printer head 29 forwardly from the printer body 6, the printer head 29 can be separated from the jammed sheet of paper 3. In this condition, the upper cover 24 is opened to expose the jammed sheet of paper 3, so that the jammed sheet of paper 3 can be easily removed through the upper opening 23 (see FIG. 9).

In modification, the upper cover 24 may be replaced by a side cover provided on one side surface of the housing 2, and the jammed sheet of paper 3 can be removed by opening the side cover.

While the ink cartridge tray 8 is linearly inserted/ejected into/from the printer body 6 by the slide mechanism in this preferred embodiment, an ink cartridge tray may be integrally provided inside a rotary door pivotably supported to the printer body 6. In this case, the ink cartridge tray is pivotally moved relative to the printer body 6 to effect the insert/eject operation of the ink cartridge tray.

While the printer 1 according to this preferred embodiment employs a line head as printing means, a serial scanning type printer head may be used in the present invention. In this case, the serial scanning type printer head may be provided on an ink cartridge tray so as to be movable in a direction perpendicular to the paper feed direction.

While the present invention is applied to a printer as computer peripheral equipment in this preferred embodiment, the present invention may be applied to any image forming means for forming an image (inclusive of characters) on a sheet of paper, such as a copying machine and a facsimile.

Further, the printing means is not limited to an ink jet type printer head, but also to an ink ribbon type printer head.

It should be noted that the specific shape and structure of each part described in this preferred embodiment are merely illustrative and that the description thereof is not to be construed as limiting the scope of the present invention.

A second preferred embodiment of the present invention will now be described with reference to FIGS. 10 to 32.

The second preferred embodiment is intended to solve the second problem mentioned above. The description of the same or like parts as those of the first preferred embodiment will be omitted herein.

Figure 10:
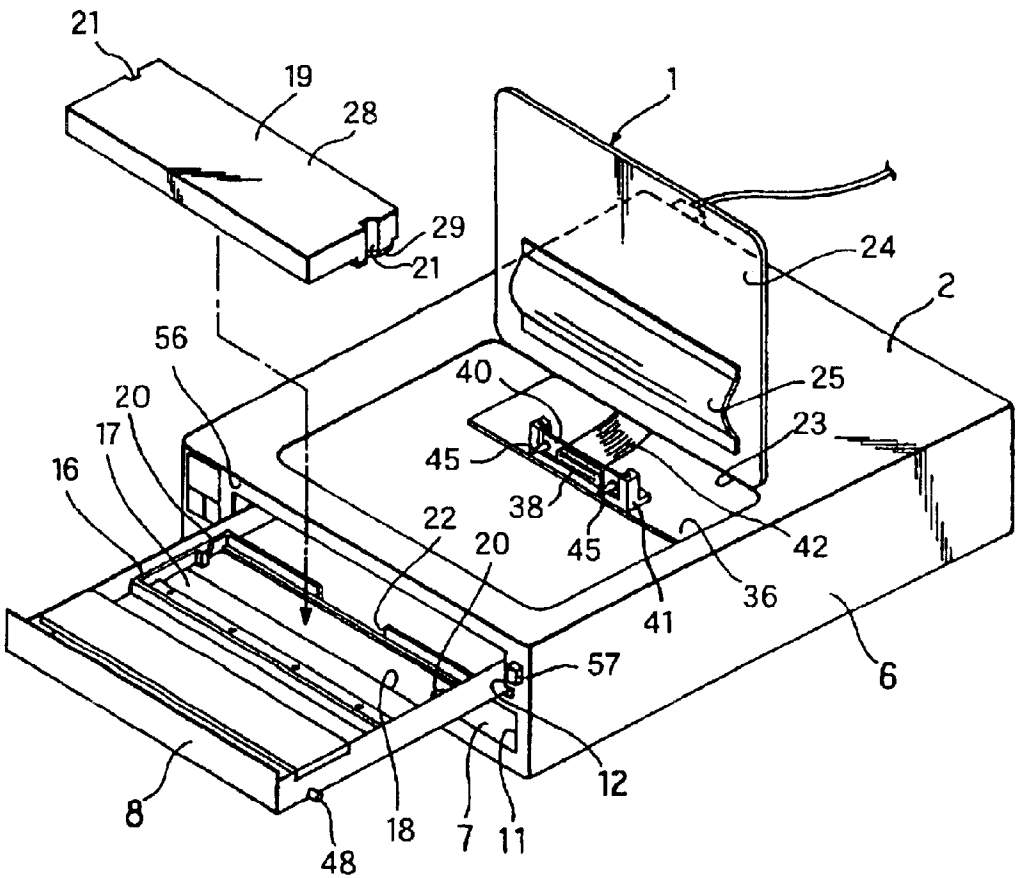
FIG. 10 is a perspective view showing a second preferred embodiment of the printer according to the present invention in the condition where an ink cartridge tray is ejected from a housing, an ink cartridge is removed from the ink cartridge tray, and an upper cover is open.
Figure 11:
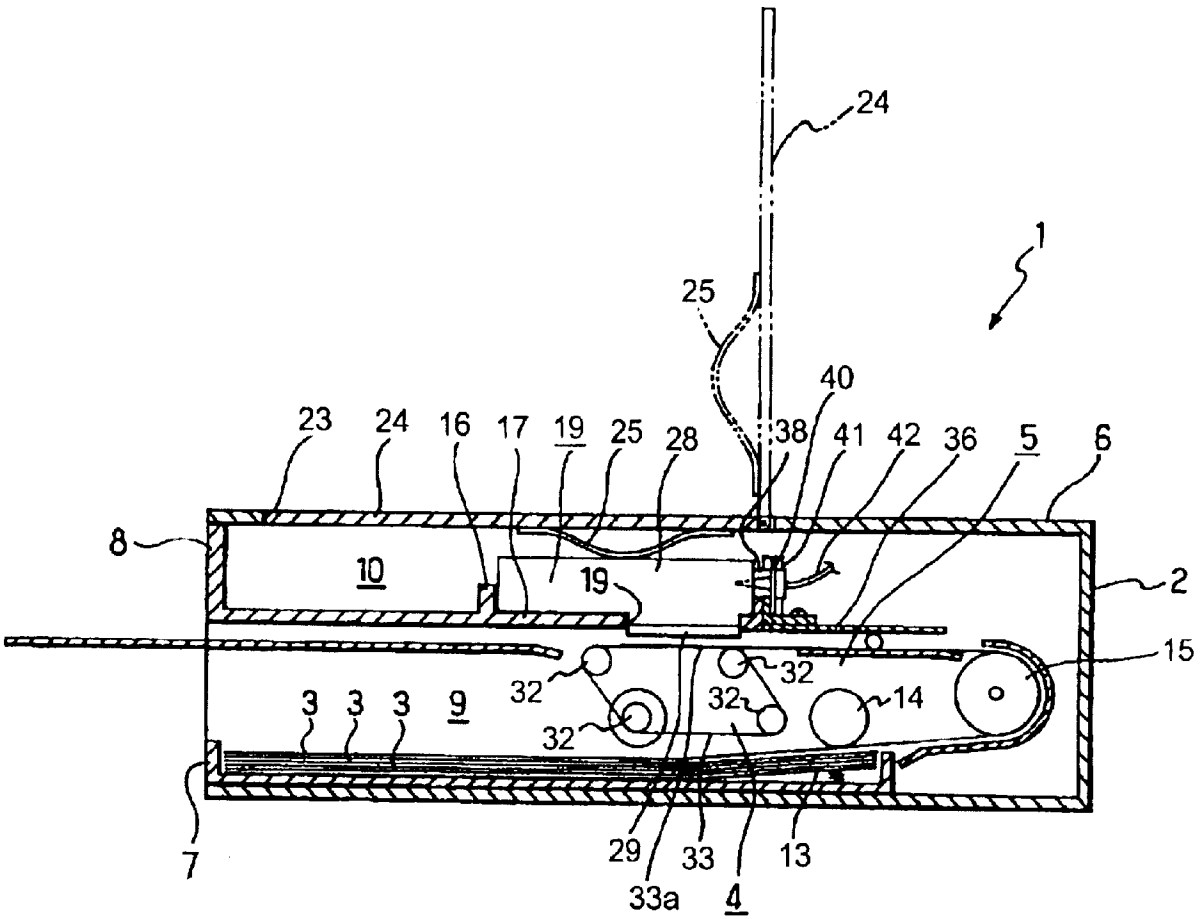
FIG. 11 is a longitudinal sectional view showing an essential part of the printer in the condition where the ink cartridge tray is fully inserted in the housing.
Figure 12:
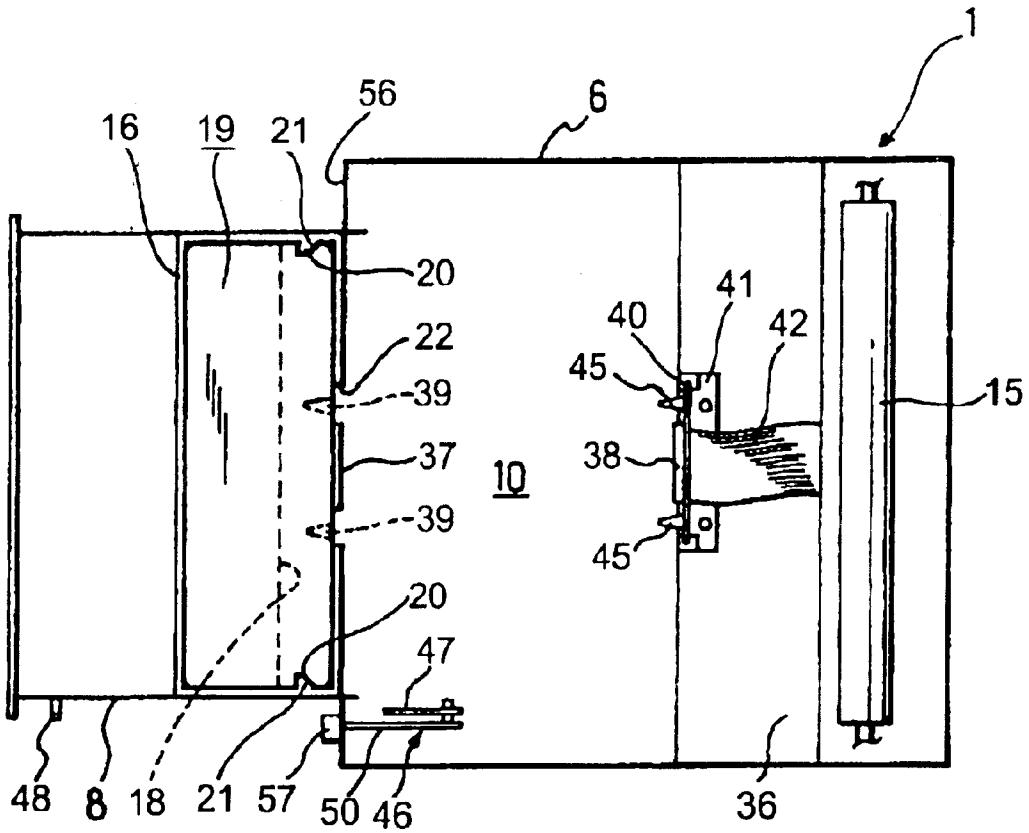
FIG. 12 is a plan view of the printer with its internal structure partially shown in the condition where the ink cartridge tray is ejected from the housing.

As shown in FIGS. 10 and 11, a fixed plate 36 as a member fixed to the printer body 6 is provided just behind the upper space 10 (on the rear side thereof), and a guide roller and a guide plate are provided around the reversing roller 15 to assist wrapping of the sheet of paper 3 around the reversing roller 15.

A connector 37 is provided on the rear surface of the ink cartridge 19 and is adapted to be electrically connected to a connector 38 provided in the printer body 6. The connector 37 will be hereinafter referred to as a cartridge connector, and the connector 38 will be hereinafter referred to as a body connector. By connecting these connectors 37 and 38, power can be supplied to the printer head 29 to effect driving of the printer head 29 (see FIGS. 12 and 13).

When the ink cartridge 19 is mounted into the storage space 17 of the ink cartridge tray 8, the cartridge connector 37 is exposed to the cutout 22 of the frame 16. When the ink cartridge tray 8 containing the ink cartridge 19 is inserted into the printer body 6, the body connector 38 is relatively inserted into the cutout 22, thereby effecting the connection between the cartridge connector 37 and the body connector 38 (see FIGS. 12 and 13).

The rear surface of the ink cartridge 19 is formed with a pair of conical recesses 39 on the right and left sides of the cartridge connector 37. As will be hereinafter described, a pair of conical projections are formed on the right and left sides of the body connector 38. The conical recesses 39 and the conical projections function as guide members for guiding the connection of the two connectors 37 and 38 (see FIGS. 14 and 15).

The body connector 38 is supported to a rectangular support board 40 having a surface perpendicular to a direction of connection of the body connector 38. The support board 40 is supported to a holder 41 fixed by screws to the upper surface of the fixed plate 36 as will be hereinafter described. With this configuration, the body connector 38 supported through the support board 40 to the holder 41 is opposed to the cartridge connector 37. A signal line 42 is connected at one end thereof to the body connector 38, and the other end of the signal line 42 is connected to an electrical circuit provided in the printer body 6 (see FIGS. 16, 17, and 18).

The holder 41 is composed of a rectangular bottom plate 43 and a pair of vertical supports 44 extending vertically at the right and left ends of the bottom plate 43. The vertical supports 44 have opposed surfaces formed with vertically extending slits 44*a*. The width of each slit 44*a* is slightly larger than the thickness of the support board 40 (see FIG. 18).

Figure 17:
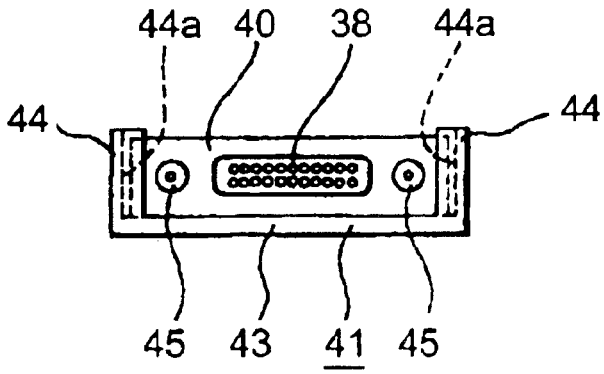
FIG. 17 is a front elevation of the body connector shown in FIG. 16.
Figure 18:
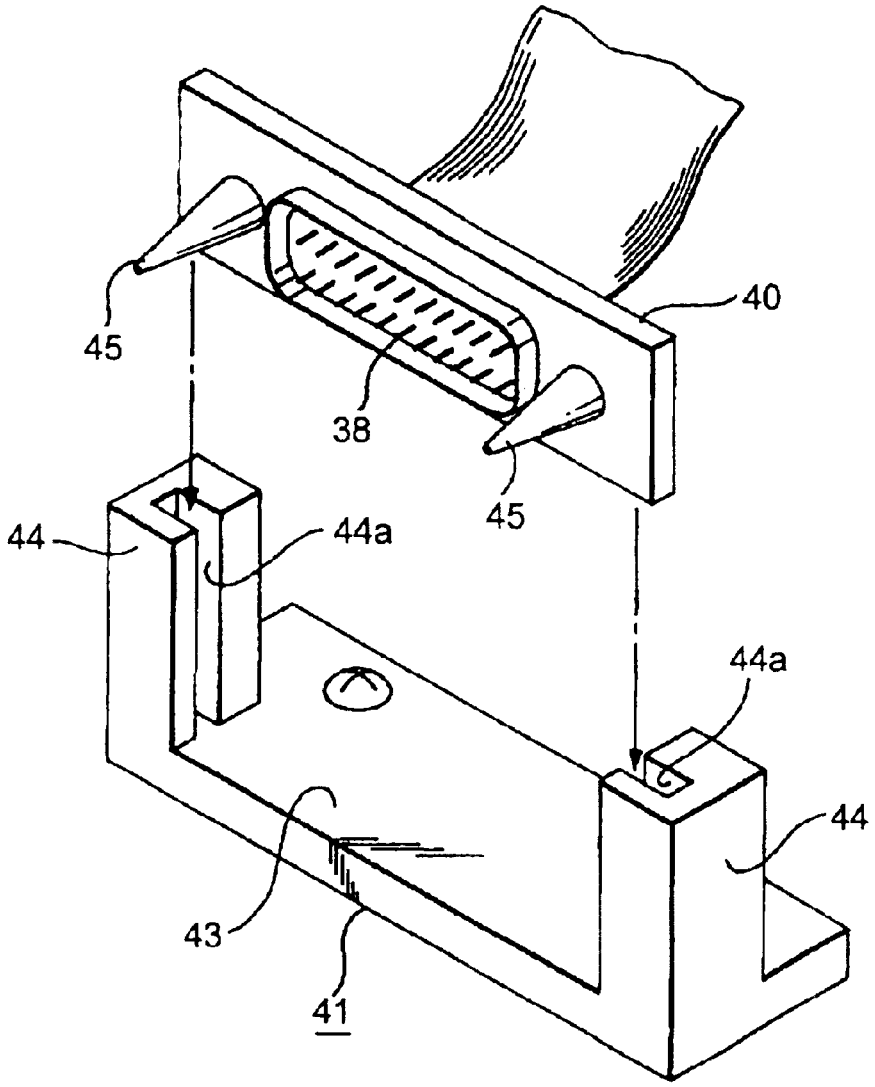
FIG. 18 is an exploded perspective view showing a manner of mounting the body connector to a holder.

The transverse length of the support board 40 is larger than the distance between the opposed surfaces of the vertical supports 44 and smaller than the distance between the bottom surfaces of the slits 44*a* of the vertical supports 44 (see FIG. 17).

Accordingly, in the condition where the support board 40 is inserted into the slits 44*a* of the vertical supports 44 from the upper side thereof, the body connector 38 is supported to the holder 41 so as to be movable transversely and vertically, and the support board 40 has a plane perpendicular to a direction of connection of the connectors 37 and 38.

The front surface of the support board 40 is formed with a pair of conical projections 45 on the right and left sides of the body connector 38. The conical projections 45 for the body connector 38 are adapted to engage with the conical recesses 39 for the cartridge connector 37, respectively, and function as guide members in cooperation with the conical recesses 39 in connecting the two connectors 37 and 38.

More specifically, even when the two connectors 37 and 38 are not aligned in inserting the ink cartridge tray 8 into the printer body 6 in such an extent that the tip of each conical projection 45 falls within the opening plane of the corresponding conical recess 39, the tip of each conical projection 45 comes into contact with the inner surface of the corresponding conical recess 39 to closely engage with the corresponding conical recess 39 as being centered, so that the support board 40 is moved transversely or vertically to thereby effect alignment of the body connector 38 and the cartridge connector 37.

Figure 13:
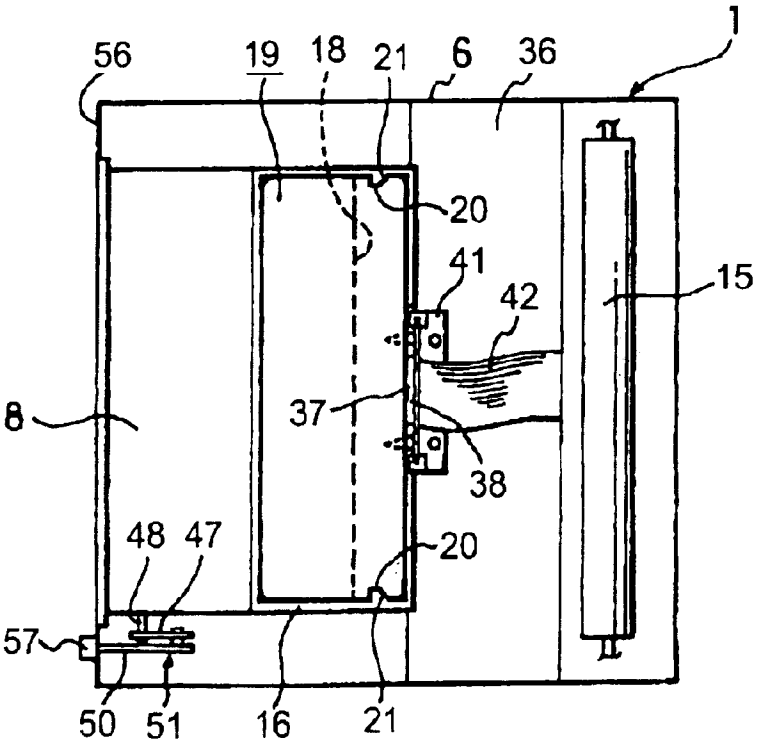
FIG. 13 is a plan view similar to FIG. 12, showing a condition where the ink cartridge tray is fully inserted in the housing.
Figure 14:
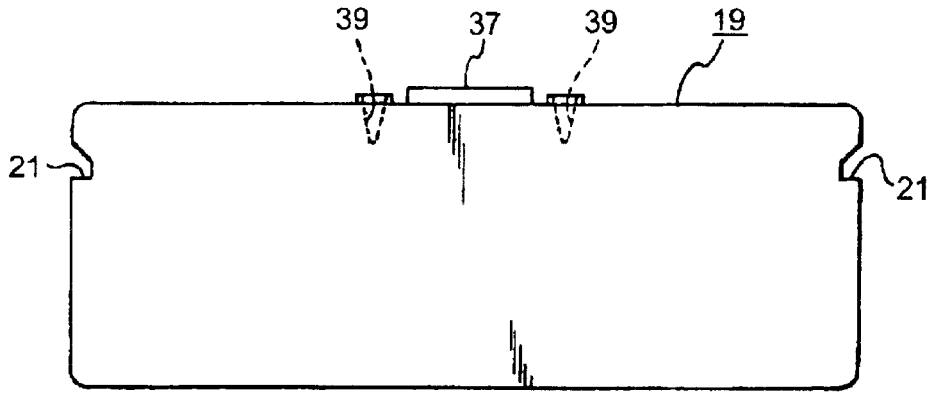
FIG. 14 is a plan view of the ink cartridge in the second preferred embodiment.
Figure 15:
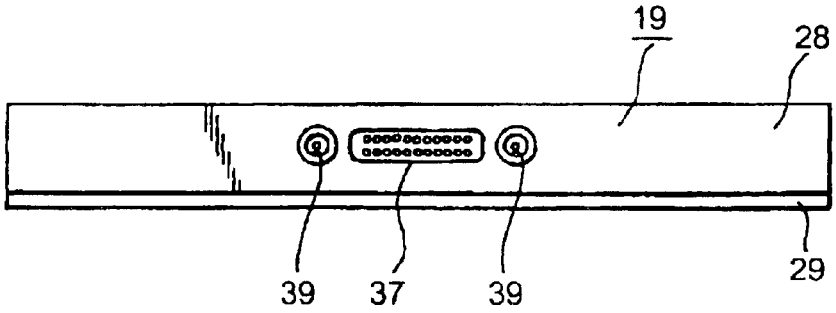
FIG. 15 is a rear elevation of the ink cartridge shown in FIG. 14.
Figure 16:
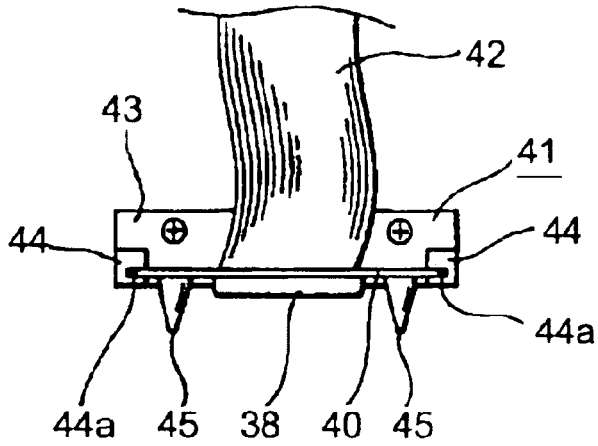
FIG. 16 is a plan view of a body connector provided in the housing in the second preferred embodiment.

In this manner, when the ink cartridge tray 8 is inserted into the printer body 6, the cartridge connector 37 provided on the ink cartridge 19 is electrically connected to the body connector 38 provided in the printer body 6, thereby supplying power to the printer head 29 of the ink cartridge 19 (see FIG. 13).

While the guide means for guiding the connection of the two connectors 37 and 38 is provided by the conical recesses 39 and the conical projections 45 respectively engaging each other in this preferred embodiment, the conical recesses 39 may be replaced by simple circular openings. Further, the conical recesses 39 and the conical projections 45 may be formed on the support board 40 and the ink cartridge 19, respectively.

Further, while the body connector 38 is movably supported to the holder 41 to follow the cartridge connector 37 of the ink cartridge 19 mounted in the ink cartridge tray 8 being inserted into the printer body 6 in the above preferred embodiment, the cartridge connector 37 may be movable and the body connector 38 may be fixed. That is, it is only necessary to absorb possible misalignment of the two connectors 37 and 38 in inserting the ink cartridge tray 8 into the printer body 6.

The paper feed system 4 is located substantially below the ink cartridge 19 mounted in the ink cartridge tray 8 inserted in the printer body 6, and the sheet of paper 3 reversed in its feed direction by the reversing roller 15 is passed under the printer head 29 (see FIG. 11).

The paper feed system 4 includes four feed rollers 32 and a feed belt 33 wrapped around the four feed rollers 32 in such a manner that the feed belt 33 forms a parallelogram as viewed in side elevation. An upper portion (paper feeding portion) 33*a* of the feed belt 33 is located in proximity to the printer head 29. Although not shown, the paper feeding portion 33*a* of the feed belt 33 is provided with a guide roller for pinching the sheet of paper 3 in cooperation with the feed belt 33 (see FIG. 11).

The sheets of paper 3 individually picked up by the pickup roller 14 are first fed toward the reversing roller 15 located behind the paper tray 7, and the feed direction of each sheet of paper 3 is then reversed to the frontward direction by the reversing roller 15. Each sheet of paper 3 is next fed to the paper feed system 4 (see FIG. 11).

The sheet of paper 3 fed to the paper feed system 4 is pinched by the guide roller (not shown) and the paper feeding portion 33*a* of the feed belt 33 and is passed under the printer head 29 in proximity thereto. At this time, printing on the sheet of paper 3 is effected by the printer head 29.

Figure 19:
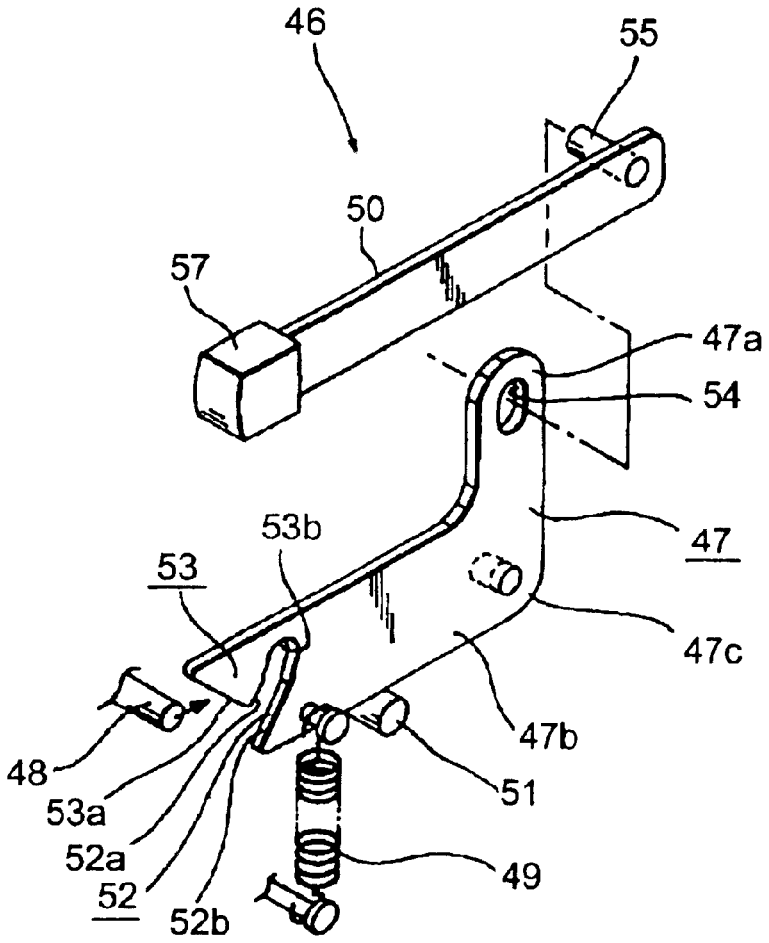
FIG. 19 is an exploded perspective view of a lock mechanism.

The printer 1 has a lock mechanism 46 for locking an inserted condition of the ink cartridge tray 8 in the printer body 6 (see FIG. 19).

The lock mechanism 46 includes a lock lever 47 having an L-shaped configuration as viewed in side elevation, a lock pin 48 fixed to the ink cartridge tray 8 and adapted to engage the lock lever 47, a return spring 49 for returning the lock lever 47 to a given position, and an operating lever 50 for operating the lock lever 47 from the front side of the housing 2 (see FIG. 19).

The lock lever 47 has a shorter portion 47*a* extending vertically, a longer portion 47*b* extending horizontally frontward from the lower end of the shorter portion 47*a*, and a bent portion 47*c* formed between the shorter portion 47*a* and the longer portion 47*b*. The lock lever 47 is pivotably supported at the bent portion 47*c* to the printer body 6. The return spring 49 is connected at one end thereof to a front end portion of the longer portion 47*b* so as to normally bias the lock lever 47 counterclockwise about the bent portion 47*c* as a fulcrum as shown in FIG. 19.

The lower edge of the longer portion 47*b* of the lock lever 47 is normally kept in abutment against a stopper pin 51 provided in the printer body 6, by a biasing force of the return spring 49 so that the longer portion 47*b* is kept in its substantially horizontal position.

The longer portion 47*b* of the lock lever 47 has a relatively large width in the vertical direction, and the front end portion of the longer portion 47*b* is formed with a cam groove 52 and a lock pawl 53.

The cam groove 52 has a width substantially equal to or slightly larger than the diameter of the lock pin 48. The cam groove 52 extends substantially vertically and opens downward.

The lower half of the cam groove 52 is deflected frontward toward the lower opening.

The lock pawl 53 is formed on the front side of the upper portion of the cam groove 52. The lock pawl 53 has a front edge formed as an inclined edge 53*a* inclined downward from the front end toward the rear end. The lock pawl 53 further has a rear edge extending from the lower end of the inclined edge 53*a* to the upper end of the cam groove 52. The upper portion of the rear edge of the lock pawl 53, that is, the upper portion of the cam groove 52 is formed as a locking portion 53*b* for locking the lock pin 48.

The lower portion of the rear edge of the lock pawl 53, that is, the lower portion of the front edge of the cam groove 52 is formed as an inclined edge inclined frontward toward the lower end. This inclined edge functions as a pull-in portion 52*a* for performing a pull-in operation in a final stage of the insert operation of the ink cartridge tray 8 into the printer body 6 as will be hereinafter described.

The lower portion of the rear edge of the cam groove 52 is formed as an inclined edge inclined frontward toward the lower end. This inclined edge functions as a push-out portion 52*b* for performing a push-out operation in an initial stage of the eject operation of the ink cartridge tray 8 from the printer body 6 as will be hereinafter described.

A vertically elongated hole 54 is formed at an upper end portion of the shorter portion 47*a* of the lock lever 47, and an engagement pin 55 provided at a rear end portion of the operating lever 50 is slidably engaged with the elongated hole 54.

The operating lever 50 is longitudinally slidably supported to the printer body 6. The rear end of the operating lever 50 is engaged with the lock lever 47 as mentioned above, and the front end of the operating lever 50 projects frontward from a front panel 56 of the printer body 6. An operating button 57 is fixed to the front end of the operating lever 50.

In the condition where the ink cartridge tray 8 is accommodated in the upper space 10 of the printer body 6 (see FIG. 28), the lock pin 48 is positioned in the locking portion 53*b* of the cam groove 52 of the lock lever 47, thereby preventing frontward movement of the ink cartridge tray 8. In this condition, the two connectors 37 and 38 are connected with each other (see FIG. 20).

The eject operation and the insert operation of the ink cartridge tray 8 will now be described.

Figure 28:
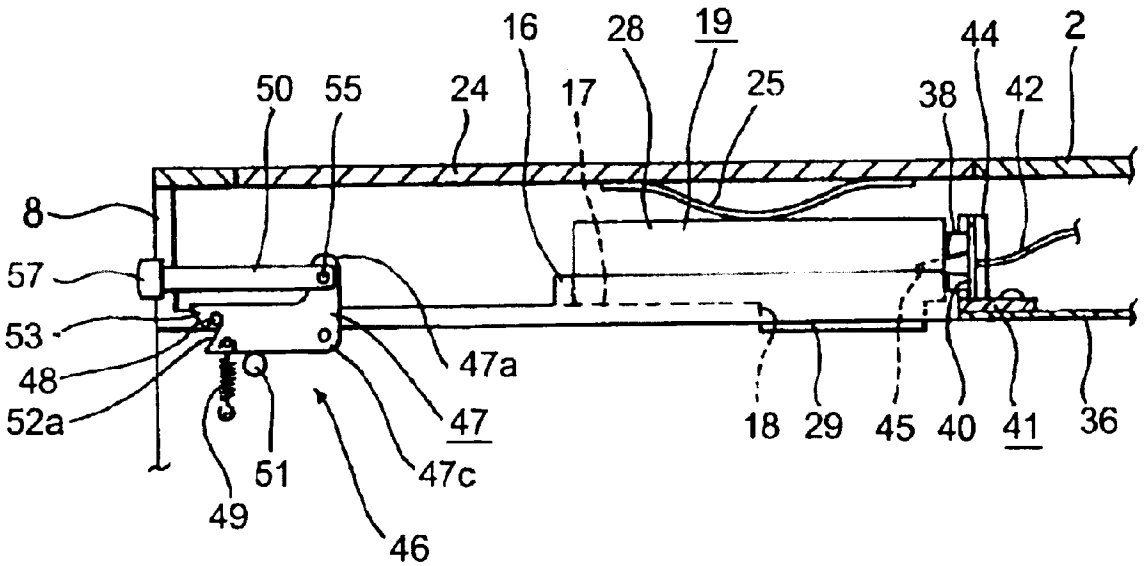
FIG. 28 is a longitudinal sectional view showing a condition where the ink cartridge tray is fully inserted in the housing and a cartridge connector provided on the ink cartridge is connected to the body connector.

The eject operation of the ink cartridge tray 8 is started by operating the operating button 57 in the inserted condition of the ink cartridge tray 8 (see FIG. 28).

Figure 21:
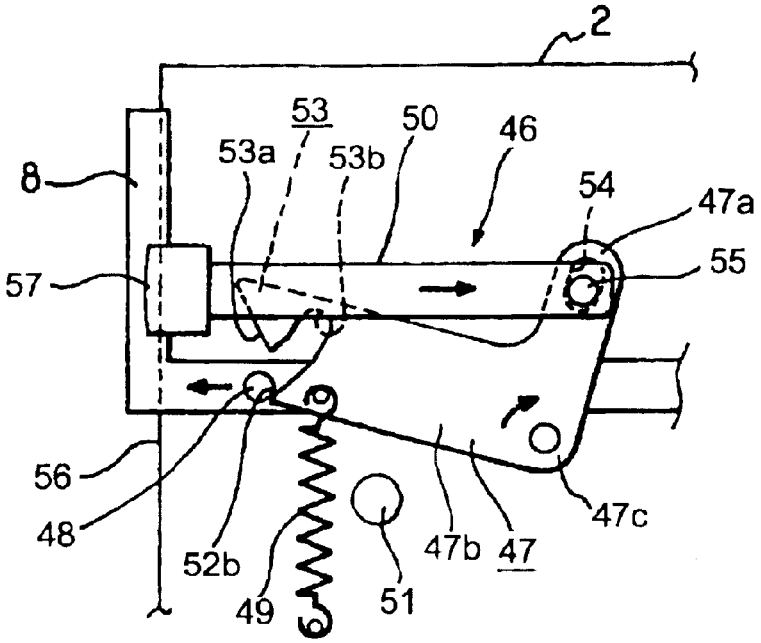
FIG. 21 is a side view showing a condition where the ink cartridge tray is pushed out of the housing by a lock lever from the condition shown in FIG. 20.

When the operating button 57 is manually operated, the operating lever 50 is pushed rearward, so that the lock lever 47 is rotated clockwise against the return spring 49 as shown in FIG. 21.

As a result, the lock pin 48 relatively moves downward in the cam groove 52, and when the lock pin 48 comes to the lower opening of the cam groove 52, the locked condition of the ink cartridge tray 8 is canceled. At this time, the lock pin 48 is depressed frontward by the push-out portion 52*b* formed at the lower portion of the cam groove 52, so that the ink cartridge tray 8 is pushed out frontward. As a result, the two connectors 37 and 38 are disconnected from each other, and the ink cartridge tray 8 is slightly moved frontward (see FIG. 21).

Figure 29:
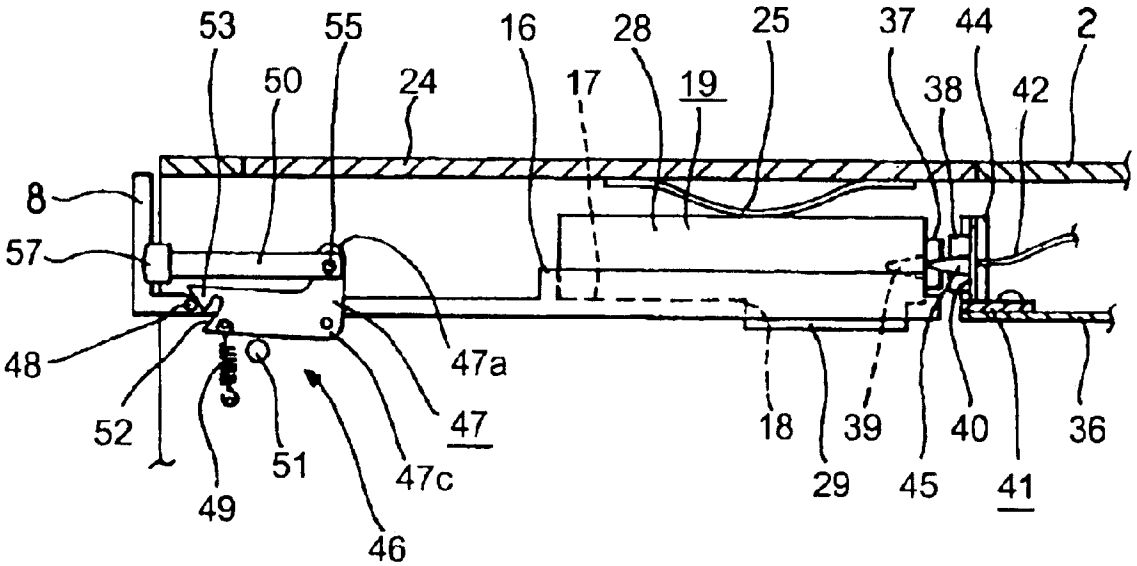
FIG. 29 is a view similar to FIG. 28, showing a condition where the ink cartridge tray is pushed out of the housing by the lock lever operated by an operating lever and the cartridge connector is disengaged from the body connector.

When the operator's hand is removed from the operating button 57 in this condition, the lock lever 47 is rotated counterclockwise by the return spring 49 and the lock pin 48 is depressed by the inclined edge 53*a* of the lock pawl 53 of the lock lever 47 (see FIG. 22), so that the lock pin 48 is further moved frontward to thereby further move the ink cartridge tray 8 frontward (see FIG. 29). Preferably, the sum of the frontward stroke of the lock pin 48 by the push-out portion 52*b* and the frontward stroke of the lock pin 48 by the inclined edge 53*a* is set equal to or slightly larger than the stroke of disconnection of the two connectors 37 and 38.

Figure 23:
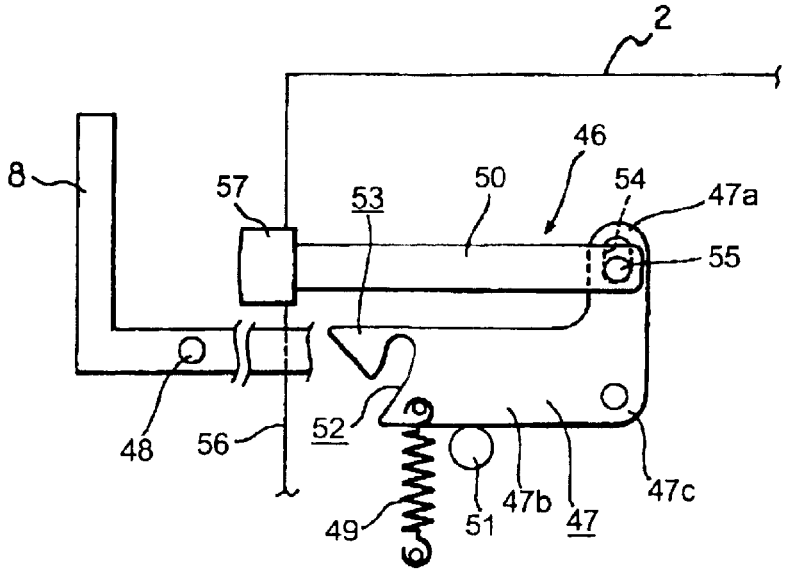
FIG. 23 is a side view showing a condition where the ink cartridge tray is made free from the condition shown in FIG. 22.
Figure 30:
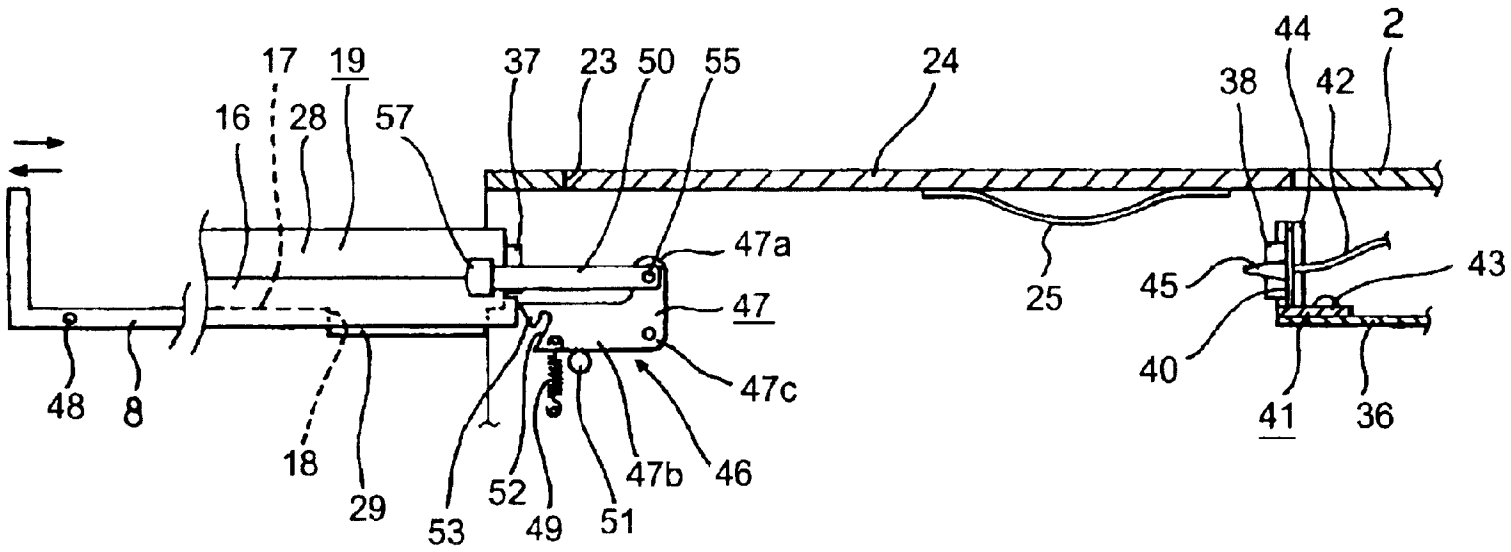
FIG. 30 is a view similar to FIG. 29, showing a condition where the ink cartridge tray is made free and fully drawn out of the housing.

When the lock pin 48 is separated from the lock lever 47, the lower edge of the longer portion 47*b* of the lock lever 47 comes into abutment against the stopper pin 51 by the biasing force of the return spring 49, so that further counterclockwise rotation of the lock lever 47 is hindered by the stopper pin 51 and the longer portion 47*b* of the lock lever 47 is kept in its horizontal position (see FIGS. 23 and 30).

In this condition, the ink cartridge tray 8 becomes free (see FIG. 23), and it can be easily drawn out manually (see FIG. 30). In modification, the eject operation of the ink cartridge tray 8 may be automatically performed by using a loading mechanism.

In this manner, the initial stage of the eject operation of the ink cartridge tray 8 is performed by operating the operating button 57, thereby making safe the eject operation of the ink cartridge tray 8.

In the initial stage, that is, until the cartridge connector 37 is disconnected from the body connector 38, a relatively large tensile force must be applied to the ink cartridge tray 8 because of the resistance between the connectors 37 and 38. If this relatively large tensile force continues to be applied even after disconnection of the connectors 37 and 38, the ink cartridge tray 8 is vigorously ejected at the time the connectors 37 and 38 are disconnected, causing a possible accident.

Figure 20:
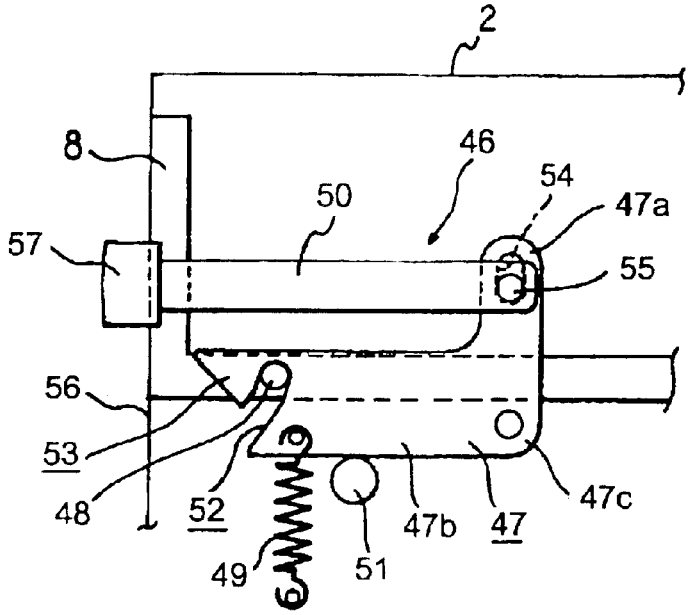
FIG. 20 is a side view showing a condition where the ink cartridge tray fully inserted in the housing is locked by the lock mechanism.
Figure 22:
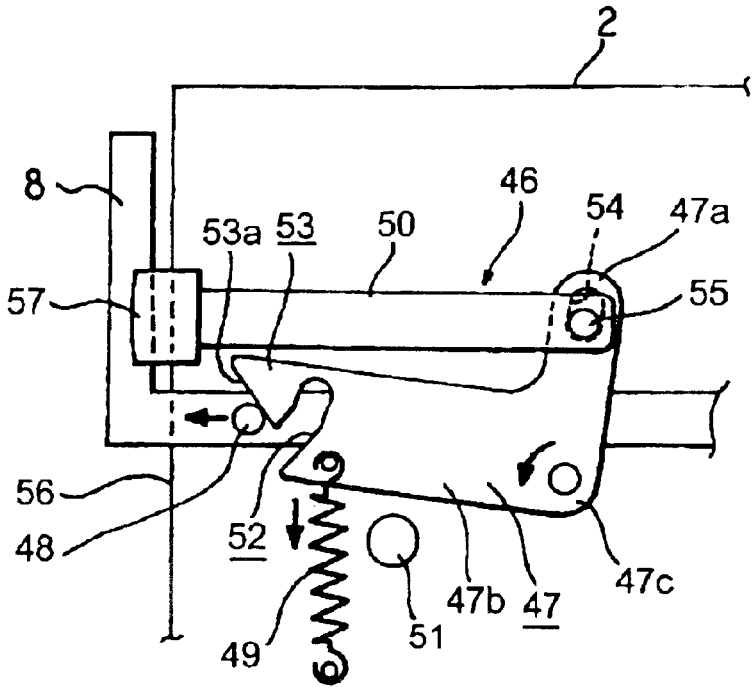
FIG. 22 is a side view showing a condition where the ink cartridge tray is further pushed out of the housing by the lock lever from the condition shown in FIG. 21.

To prevent such an accident, the ink cartridge tray 8 is first ejected by operating the operating lever 50 until the connectors 37 and 38 are disconnected (see FIGS. 20 to 22). After the connectors 37 and 38 are disconnected, the ink cartridge tray 8 is manually ejected (see FIG. 23). Accordingly, the ink cartridge tray 8 can be ejected safely (see FIG. 30).

On the other hand, the insert operation of the ink cartridge tray 8 is performed by manually pushing the ink cartridge tray 8 into the printer body 6.

Figure 24:
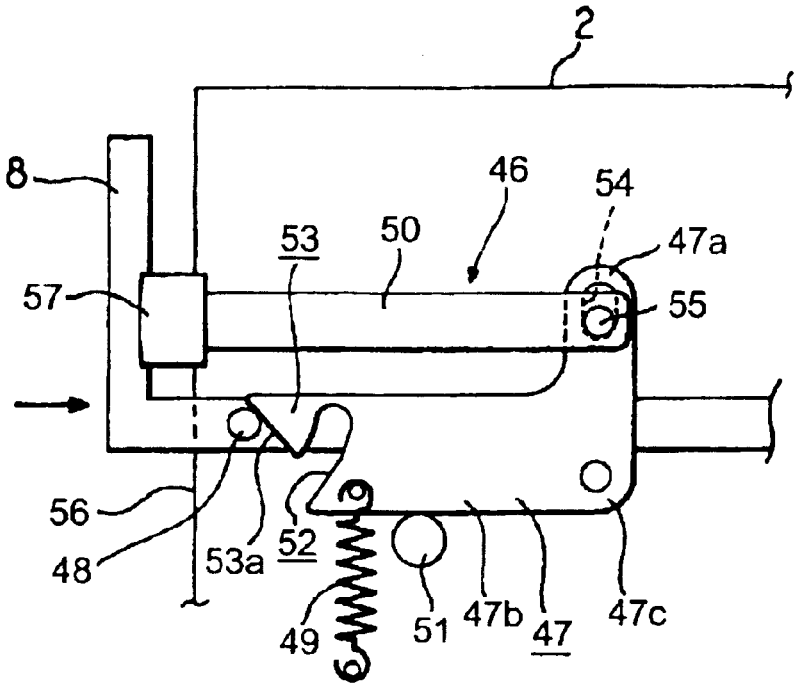
FIG. 24 is a side view showing a condition where the ink cartridge tray is inserted into the housing and a lock pin is about to start acting on the lock lever.
Figure 31:
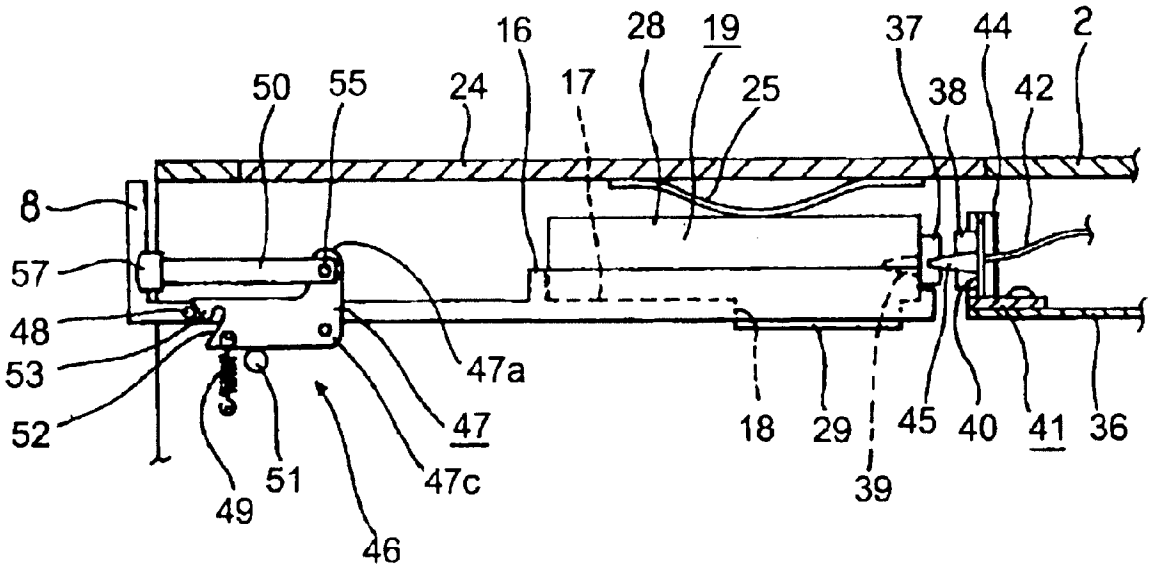
FIG. 31 is a view similar to FIG. 30, showing a condition where the ink cartridge tray is inserted into the housing by the operator until the lock pin abuts against the lock lever, but the cartridge connector has not yet been connected to the body connector.
Figure 32:
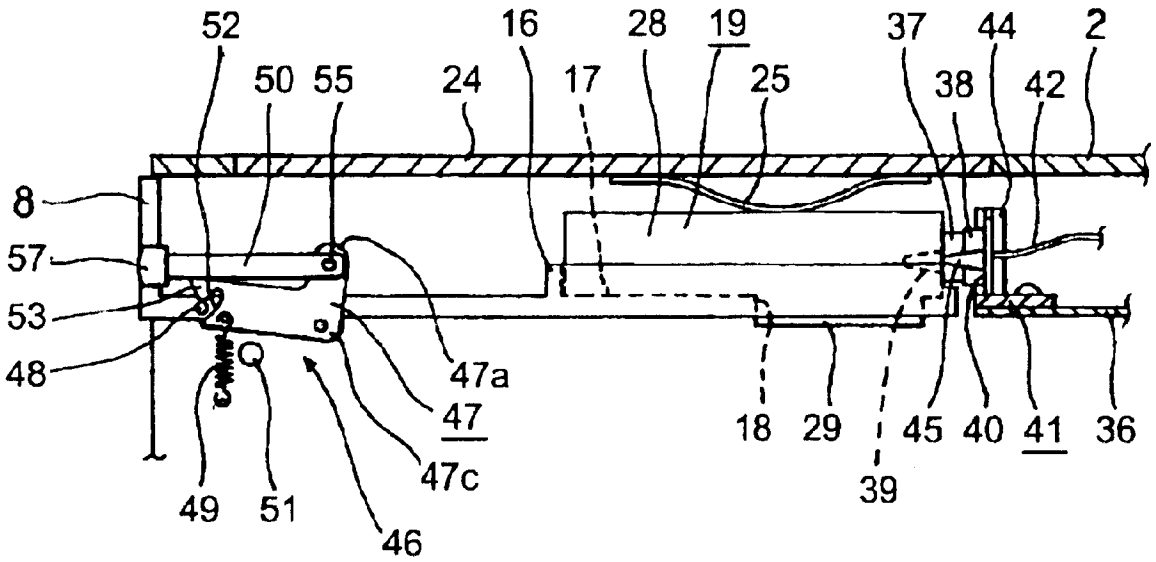
FIG. 32 is a view similar to FIG. 31, showing a condition where the ink cartridge tray is mechanically pulled into the housing by the lock lever driven by a return spring, and the cartridge connector starts to be connected to the body connector.

When the ink cartridge tray 8 is pushed into the printer body 6, the lock pin 48 comes into abutment against the inclined edge 53*a* of the lock pawl 53 of the lock lever 47 (see FIGS. 24 and 31).

Figure 25:
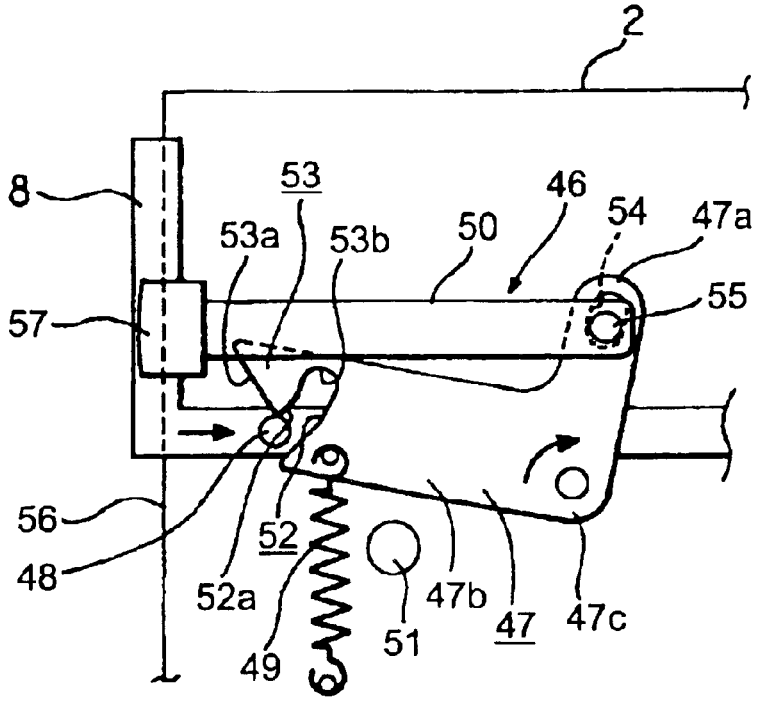
FIG. 25 is a side view showing a condition where the ink cartridge tray is further inserted from the condition shown in FIG. 24.
Figure 26:
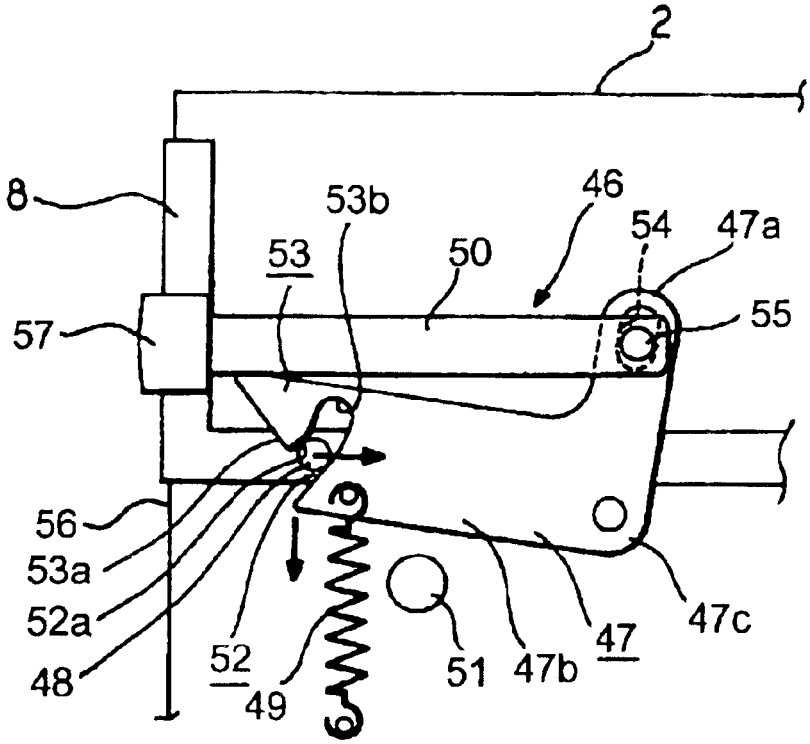
FIG. 26 is a side view showing a condition where the lock pin is depressed by a pull-in portion of the lock lever to mechanically pull the ink cartridge tray from the condition shown in FIG. 25.

When the ink cartridge tray 8 is further pushed, the lock pin 48 operates to displace the lock pawl 53 upward, so that the lock lever 47 is rotated clockwise against the return spring 49 (see FIG. 25).

The lock pin 48 is further moved rearward to pass the lower end of the lock pawl 53 and to next enter the cam groove 52 (see FIG. 25). In this condition, the connectors 37 and 38 have not yet been connected together, but are about to start the connection (see FIG. 32).

When the lock pin 48 is inserted into the cam groove 52, the lock lever 47 is rotated counterclockwise by the return spring 49 and the lock pin 48 is depressed by the pull-in portion 52*b* of the cam groove 52, so that the lock pin 48 is forced rearward by the pull-in portion 52*b*. Accordingly, the ink cartridge tray 8 is moved rearward to be pulled into the printer body 6 (see FIG. 26).

Figure 27:
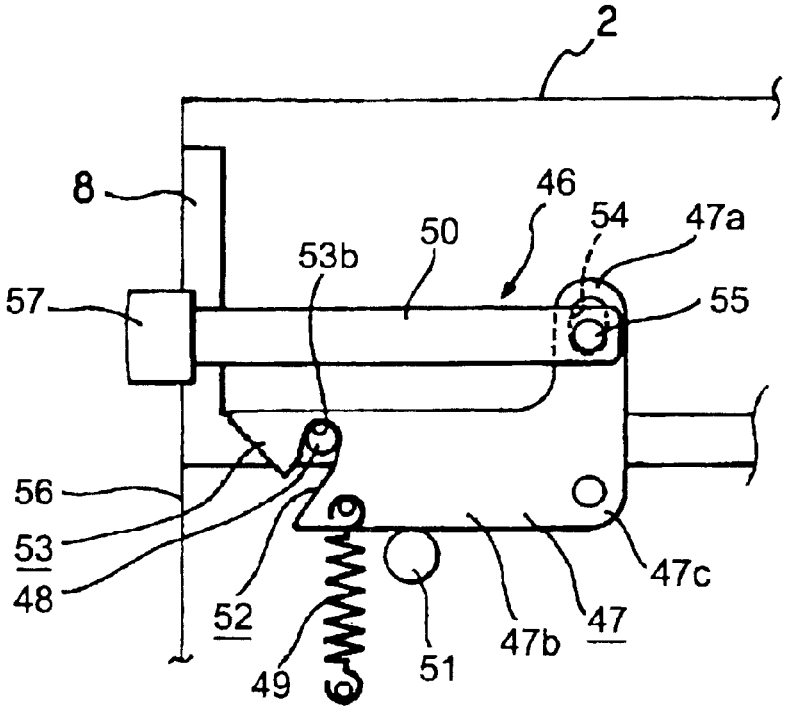
FIG. 27 is a side view showing a locked condition subsequent to the condition shown in FIG. 26.

When the lock pin 48 reaches the upper end of the cam groove 52, that is, reaches the locking portion 53*b* of the lock pawl 53, the ink cartridge tray 8 is locked so that its longitudinal movement is inhibited (see FIG. 27).

At this time, the two connectors 37 and 38 are connected together to effect the electrical connection between the ink cartridge 19 and the printer body 6 (see FIG. 28).

In this manner, the final stage of the insert operation of the ink cartridge tray 8 is not required to be manually performed, so that the insert operation of the ink cartridge tray 8 can be performed safely.

If the connection of the connectors 37 and 38 in the final stage of the insert operation is also manually performed, a depression force applied to the ink cartridge tray 8 during the insert operation must be increased at the time the cartridge connector 37 starts to be connected to the body connector 38. Accordingly, in the case that the printer body 6 is light in weight, the printer body 6 may be moved by the above increased depression force. To avoid this undesirable movement of the printer body 6, the printer body 6 must be held in the final stage of the insert operation of the ink cartridge tray 8.

According to this preferred embodiment, the final stage of the insert operation of the ink cartridge tray 8 is performed by the rotation of the lock lever 47 driven by the return spring 49, so that manual insertion in the final stage is not required, thereby eliminating the above problem of undesirable movement of the printer body 6.

Further, the lock pin 48 relatively inserted into the cam groove 52 is held at the locking portion 53*b* to lock the ink cartridge tray 8 inserted in the printer body 6, thereby preventing undue removal of the ink cartridge tray 8 from the printer body 6.

Thus, the eject operation and the insert operation of the ink cartridge tray 8 and the locking operation thereof can be performed safely and reliably by providing the lock mechanism 46.

In the printer 1 according to this preferred embodiment, the insert and eject operations of the ink cartridge tray 8 are performed by the slide mechanism. Accordingly, a known slide mechanism for a tape cassette or a disc cartridge, for example, may be used also for the slide mechanism for the ink cartridge tray 8, so that this slide mechanism can be realized with a relatively simple structure.

In the printer 1 according to this preferred embodiment, the ink cartridge 19 includes the ink tank 28 and the printer head 29 integrated with each other, so that an ink passage between the ink tank 28 and the printer head 29 can be formed as a closed space (because the ink passage is entirely formed in the ink cartridge 19). Accordingly, as compared with a case where the ink tank 28 and the printer head 29 are separated from each other, a problem of ink leakage or the like can be suppressed. The printer of the present invention is applicable also to a separate type such that a printer head is provided in an ink cartridge tray and an ink tank is replaceably mounted to the printer head.

While the two connectors 37 and 38 are used to supply power from the printer body 6 to the printer head 29 provided in the ink cartridge 19 in this preferred embodiment, the two connectors 37 and 38 may be used for communication between the ink cartridge 19 and the printer body 6 regarding information on the ink cartridge 19 (consumable), e.g., various items of information such as the remaining amount of ink, the kind of ink, and the date of manufacture of ink.

While the ink cartridge tray 8 is linearly inserted/ejected into/from the printer body 6 by the slide mechanism in this preferred embodiment, an ink cartridge tray may be integrally provided inside a rotary door pivotably supported to the printer body 6. In this case, the ink cartridge tray is pivotally moved relative to the printer body 6 to effect the insert/eject operation of the ink cartridge tray.

While the printer 1 according to this preferred embodiment employs a line head as printing means, a serial scanning type printer head may be used in the present invention. In this case, the serial scanning type printer head may be provided on an ink cartridge tray so as to be movable in a direction perpendicular to the paper feed direction.

While the present invention is applied to a printer as computer peripheral equipment in this preferred embodiment, the present invention may be applied to any image forming means for forming an image (inclusive of characters) on a sheet of paper, such as a copying machine and a facsimile. Further, the printing means is not limited to an ink jet type printer head, but also to an ink ribbon type printer head.

It should be noted that the specific shape and structure of each part described in this preferred embodiment are merely illustrative and that the description thereof is not to be construed as limiting the scope of the present invention.

As apparent from the above description, there is provided according to an aspect of the present invention a printer having a printer body and a consumable related to printing means, the consumable being replaceably mounted in the printer body, the consumable having a printer head, the printer comprising a consumable tray movably provided in the printer body for detachably storing the consumable and a pair of connectors for connecting the printer head and the printer body; the connectors being connected or disconnected by the insertion or election of the consumable tray into or from the printer body.

With this configuration, the replacement of the consumable can be very easily performed by simply ejecting the consumable tray from the printer body. Thus, it is possible to provide a printer improved in usability. Furthermore, time and effort for connection of the consumable and the printer head are not required, and the electrical connection between the printer head and the printer body can be effected by simply inserting the consumable tray into the printer body, thereby greatly improving the workability.

According to the invention as defined in claim 2, the consumable tray is movable by a slide operation relative to the printer body. Accordingly, a structure for effecting the movement of the consumable tray can be simplified.

According to the invention as defined in claim 4, the printer further comprises depression means for depressing the consumable tray inserted in the printer body against a sheet of paper. Accordingly, in the case that the consumable is provided with a printer head, the printer head can be positioned simply and reliably with respect to the sheet of paper.

According to the invention as defined in claim 5, the printer further comprises positioning means for positioning the consumable tray in a direction of insertion of the consumable tray into the printer body. Accordingly, in the case that the consumable is provided with a printer head, the printer head can be reliably positioned with respect to the sheet of paper.

According to the invention as defined in claim 6, the printer further comprises positioning means for positioning the consumable tray in a direction across a gap defined between the consumable tray and a sheet of paper. Accordingly, in the case that the consumable is provided with a printer head, the printer head can be reliably positioned with respect to the sheet of paper.

According to another aspect of the present invention, there is provided a printer having a printer body and a consumable related to printing means, the consumable being replaceably mounted in the printer body, the printer comprising a consumable tray movably provided in the printer body for detachably storing the consumable; a first connector provided on the consumable or the consumable tray; and a second connector provided in the printer body; the first connector being connected to the second connector when the consumable tray is inserted into the printer body.

With this configuration, the replacement of the consumable can be very easily performed by simply ejecting the consumable tray from the printer body. Moreover, the electrical connection between the consumable and the printer body can be effected by simply inserting/ejecting the consumable tray into the printer body. Thus, it is possible to provide a printer improved in usability.

According to the invention as defined in claim 8, the first connector is provided on the consumable related to printing means. Accordingly, electrical connection between information on the consumable and the printer body or a component attached to the consumable and the printer body can be directly made, and a structure for effecting the electrical connection can be simplified.

According to the invention as defined in claim 9, the second connector is supported to the printer body so as to be movable in a plane perpendicular to a direction of insertion of the consumable tray into the printer body. Accordingly, even when the first and second connectors are not aligned in inserting the consumable tray into the printer body, the misalignment can be easily corrected. Further, the dimensional accuracy in the first and second connectors, the printer body, and the consumable tray can be set rough, thus contributing to a reduction in manufacturing cost.

According to the invention as defined in claim 10, the printer further comprises a guide member for aligning the first connector to the second connector in inserting the consumable tray into the printer body. Accordingly, the first and second connectors can be reliably connected together by simply inserting the consumable tray into the printer body.

According to the invention as defined in claim 11, the printer further comprises a lever for moving the consumable tray in a direction of ejection of the consumable tray from the printer body by an amount corresponding to a stroke of disconnection of the first and second connectors connected together. Accordingly, the workability of ejection of the consumable tray from the printer body can be improved.

According to the invention as defined in claim 12, the printer further comprises a lever for moving the consumable tray in a direction of insertion of the consumable tray into the printer body by an amount corresponding to a stroke of connection of the first and second connectors. Accordingly, even when the printer body is light in weight, it is possible to reliably prevent the printer body from being moved in inserting the consumable tray into the printer body.

What is claimed is:

1. A printer having a printer, body and a consumable means related to printing means, said consumable being replaceably mounted in said printer body, said printer comprising:

a consumable tray movably provided in said printer body for detachably storing said consumable means; and a depression means for depressing said consumable tray inserted in said printer body against a sheet of paper.

2. The printer according to claim 1, wherein said consumable tray is movable by a slide operation relative to said primer body.

3. The printer according to claim 1, further comprising positioning means for positioning said consumable tray in a direction of insertion of said consumable tray into said printer body.

4. The printer according to claim 1, further comprising positioning means for positioning said consumable tray in a direction across a gap defined between said consumable tray and a sheet of paper.

5. A printer having a primer body and a consumable means related to printing means, said consumable being replaceably mounted in said printer body, said printer comprising:

a consumable tray movably provided in said printer body for detachably storing said consumable means;

a first connector provided on said consumable means or said consumable tray;

a second connector provided in said printer body;

said first connector being connected to said second connector when said consumable tray is inserted into said printer body; and a depression means for depressing said consumable tray inserted in said printer body against a sheet of paper.

6. The printer according to claim 5, wherein said first connector is provided on said consumable means.

7. The printer according to claim 5, wherein said second connector is supported to said printer body so as to be movable in a plane perpendicular to a direction of insertion of said consumable tray into said printer body.

8. The printer according to claim 5, further comprising a guide member for aligning said first connector to said second connector in inserting said consumable tray into said printer body.

9. The printer according to claim 5, further comprising a lever for moving said consumable tray in a direction of ejection of said consumable tray from said printer body by an amount corresponding to a stroke of disconnection of said first and second connectors connected together.

10. The printer according to claim 5, further comprising a lever for moving said consumable tray in a direction of insertion of said consumable tray into said printer body by an amount corresponding to a stroke of connection of said first and second connectors.

* * * * *